US012642377B2

(12) United States Patent
McNaughton

(10) Patent No.: US 12,642,377 B2
(45) **Date of Patent: *Jun. 2, 2026**

(54) CUP HOLDER ADAPTOR ASSEMBLY

(71) Applicant: McNaughton Incorporated, Plymouth, MN (US)

(72) Inventor: Patrick James McNaughton, Plymouth, MN (US)

(73) Assignee: McNaughton Incorporated, Plymouth, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/636,791

(22) Filed: Apr. 16, 2024

(65) Prior Publication Data

US 2025/0082121 A1 Mar. 13, 2025

Related U.S. Application Data

(63) Continuation of application No. 17/874,218, filed on Jul. 26, 2022, now Pat. No. 11,986,110.

(51) Int. Cl.
*A47G 23/02* (2006.01)

(52) U.S. Cl.
CPC ..... *A47G 23/0216* (2013.01)

(58) Field of Classification Search
CPC ..... A47G 23/0216
USPC ..... 248/311.2
See application file for complete search history.

(56) References Cited

U.S. PATENT DOCUMENTS 2,487,014 A * 11/1949 Amberg ..... A47G 19/03 285/345
2,729,080 A * 1/1956 Bennett ..... A47G 23/0216 248/314
3,091,361 A 5/1963 Gawron
3,232,512 A * 2/1966 Wanderer ..... B29C 57/12 264/550

(Continued)

FOREIGN PATENT DOCUMENTS

CN 201238930 Y 5/2009
KR 200386523 Y1 6/2005

(Continued)

OTHER PUBLICATIONS

Cup Keeper Plus Car Cup Holder Adapter, first available Jun. 3, 2022, Amazon, [online], [site visited Feb. 14, 2023], Available from internet URL:https://www.amazon.com/Adapter-Expands-Beverage-Containers-Diameter/dp/BOB3589C7R?th=1 (Year: 2022).*

(Continued)

*Primary Examiner* — Kimberly T Wood
(74) *Attorney, Agent, or Firm* — Fredrikson & Byron, P.A.

(57) ABSTRACT

A cup holder adaptor assembly includes a portable cup holder and a cup deck. The cup deck is configured to be mounted removably within a lower section of the portable cup holder, such that when the cup deck is mounted removably within the lower section of the portable cup holder a storage compartment is created between the cup deck and a bottom of the portable cup holder. The cup holder adaptor assembly is configured such that the cup deck can be selectively mounted within the lower section of the portable cup holder in either of two configurations, the two configurations being a first configuration and a second configuration.

22 Claims, 35 Drawing Sheets

(56) References Cited

U.S. PATENT DOCUMENTS

| | | | | | |
|---|---|---|---|---|---|
| 3,246,786 | A | | 4/1966 | Danforth | |
| 3,598,271 | A | | 8/1971 | Holley | |
| 4,494,668 | A | | 1/1985 | Lottick | |
| 5,040,719 | A | * | 8/1991 | Ballway | A47G 19/2205 220/504 |
| 5,088,673 | A | * | 2/1992 | Chandler | B60N 3/103 D7/619.1 |
| 5,174,534 | A | * | 12/1992 | Mitchell | B60N 3/103 D7/619.1 |
| D332,891 | S | * | 2/1993 | Cumberland | D7/619.1 |
| 5,273,182 | A | | 12/1993 | Laybourne | |
| 5,285,953 | A | | 2/1994 | Smith | |
| D361,017 | S | * | 8/1995 | Keven | D7/619.1 |
| D370,392 | S | * | 6/1996 | Flanagan | D7/619.1 |
| D380,650 | S | * | 7/1997 | Norris | D7/619.1 |
| D397,915 | S | * | 9/1998 | McNaughton | D7/619.1 |
| D400,763 | S | * | 11/1998 | Taylor | D7/619.1 |
| D439,116 | S | * | 3/2001 | White | D7/619.1 |
| 6,796,670 | B2 | * | 9/2004 | Winters | A47G 23/0309 362/34 |
| D501,118 | S | * | 1/2005 | Schrock | D7/619.1 |
| D580,233 | S | * | 11/2008 | Camarota | D7/619.1 |
| 8,061,670 | B1 | * | 11/2011 | White | B60N 3/10 248/311.2 |
| D675,882 | S | * | 2/2013 | Crockett | D7/619.1 |
| D767,279 | S | * | 9/2016 | Gummo | D3/315 |
| 9,801,483 | B2 | | 10/2017 | D'Alesio | |
| 10,717,396 | B2 | | 7/2020 | Macneil et al. | |
| D906,229 | S | * | 12/2020 | Han | D12/419 |
| 11,254,253 | B1 | * | 2/2022 | Fan | B60N 3/106 |
| D957,882 | S | * | 7/2022 | Yueh | D7/523 |
| 11,415,266 | B2 | | 8/2022 | Zimmerman | |
| 2015/0114963 | A1 | | 4/2015 | Billett | |
| 2015/0342382 | A1 | * | 12/2015 | D'Alesio | A47G 23/0216 220/737 |
| 2016/0009465 | A1 | | 1/2016 | Pan | |

FOREIGN PATENT DOCUMENTS

| | | | | | |
|---|---|---|---|---|---|
| KR | 20130012041 | A | * | 1/2013 | A47G 23/0313 |
| WO | WO-2017001711 | A1 | * | 1/2017 | A47G 19/22 |

OTHER PUBLICATIONS

Design U.S. Appl. No. 29/806,371, entitled "Variable Diameter Cup Holder Assembly," filed Sep. 2, 2021.

Gadjit Cup Keeper PLUS—Cup Holder Adapter, McInc, [online], [site visited Mar. 6, 2023], Available from internet URL: https://www.mcincshop.com/product-page/gadjit-cup-keeper-plus-cup-holder-adapter (Year: 2023).

* cited by examiner 1
109
100
LA
93
10
90
95
28
91
26
20
22
21

1
109
100
LA
95
90
10
28
26
20
91
22
21

1

109
100
LA
95
90
10
28
91
26
20
22
21

1
109
100
LA
10
95
28
26
91
22
20
21

CUP HOLDER ADAPTOR ASSEMBLY

CROSS-REFERENCE TO RELATED APPLICATION(S)

This application is a continuation of U.S. patent application Ser. No. 17/874,218, filed Jul. 26, 2022 and entitled CUP HOLDER ADAPTOR ASSEMBLY, which is hereby incorporated herein by reference in its entirety.

FIELD OF THE INVENTION

The present invention relates to a cup holder. More specifically, the invention provides a portable cup holder configured to be inserted removably into the built-in cup holders of vehicles so as to enable holding cups, cans, and bottles of various sizes and shapes.

BACKGROUND OF THE INVENTION

Various portable cup holders are known. U.S. Pat. No. D397,915 (McNaughton) discloses an advantageous adaptable beverage holder. While existing portable cup holders provide advantages over the built-in cup holders found in many automobiles, it would be desirable to provide a portable cup holder that has additional utility. As one example, it would be desirable to provide a portable cup holder that can stably receive therein a cup, can, or bottle, even when spare change (e.g., coins) and/or other small articles are also received in the portable cup holder. It would be particularly desirable to provide a portable cup holder of this nature wherein a wide variety of differently shaped and sized cups, cans, and bottles can be stably received.

SUMMARY OF THE INVENTION

Certain embodiments of the invention provide a cup holder adaptor assembly comprising a portable cup holder and a cup deck. In the present embodiments, the cup deck is configured to be mounted removably within the portable cup holder (optionally a lower section thereof), such that when the cup deck is mounted removably within the portable cup holder (e.g., within the lower section thereof), a storage compartment is created between the cup deck and a bottom of the portable cup holder.

DETAILED DESCRIPTION OF VARIOUS EMBODIMENTS

Figure 1:
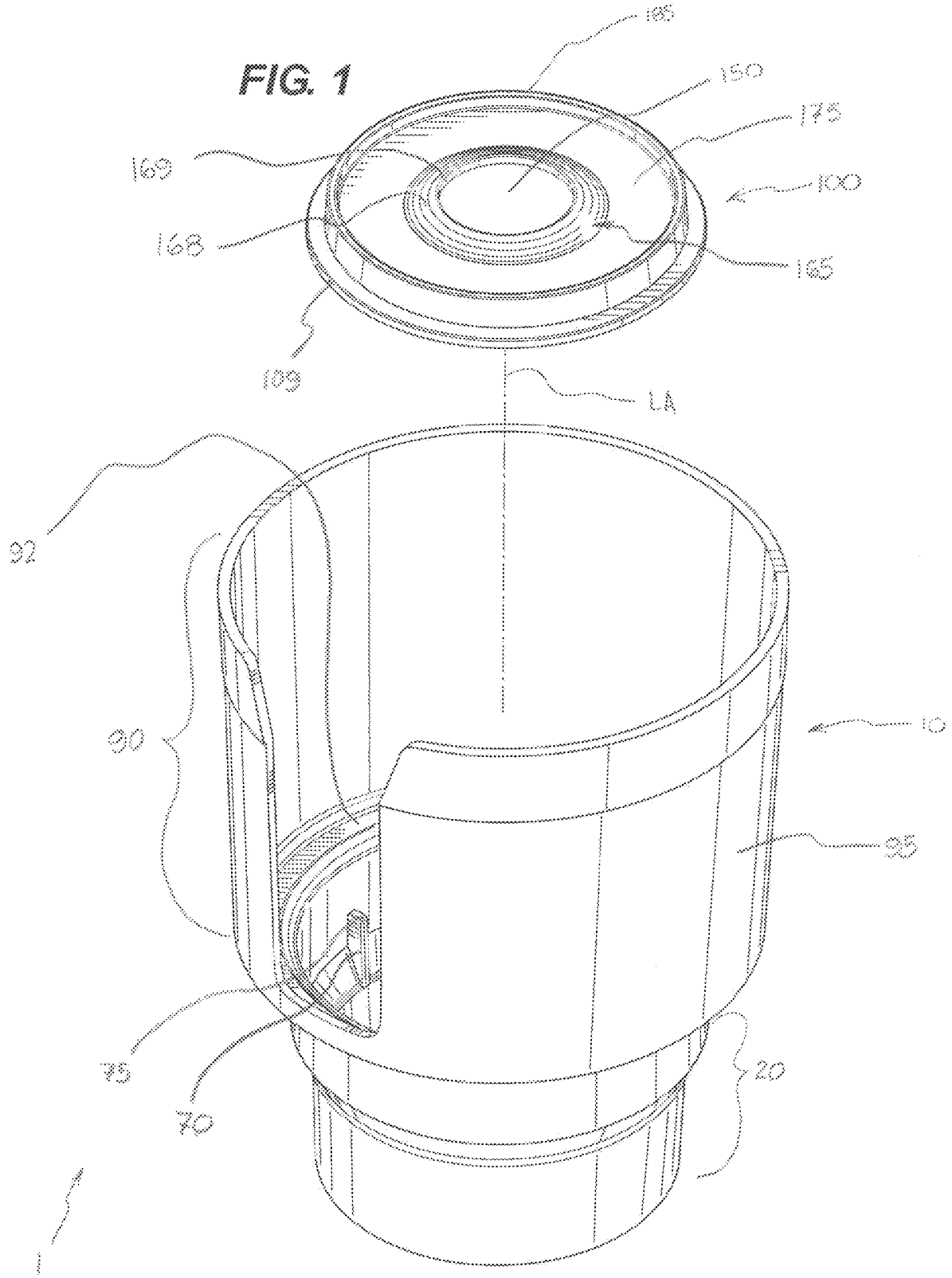
FIG. 1 is an exploded perspective view of a cup holder adaptor assembly in accordance with certain embodiments of the present disclosure, with a cup deck of the assembly in a first configuration.

The following detailed description is to be read with reference to the drawings, in which like elements in different drawings have like reference numerals. The drawings, which are not necessarily to scale, depict selected embodiments and are not intended to limit the scope of the invention. Skilled artisans will recognize that the examples provided herein have many useful alternatives that fall within the scope of the invention.

Referring to the drawings, there is shown a non-limiting embodiment of a cup holder adaptor assembly, which is generally identified by reference number 1. The cup holder adaptor assembly 1 includes a portable cup holder 10 and a cup deck 100. The cup deck 100 is configured to be mounted removably within the portable cup holder 10 (optionally within a lower section 20 thereof), such that when the cup deck 100 is mounted removably within the portable cup holder 10 (e.g., within the lower section 20 thereof), a storage compartment is created between the cup deck 100 and a bottom 21 of the portable cup holder. Reference is made to FIGS. 15, 22, 29, 30, 35, and 36B-36D.

Figure 29:
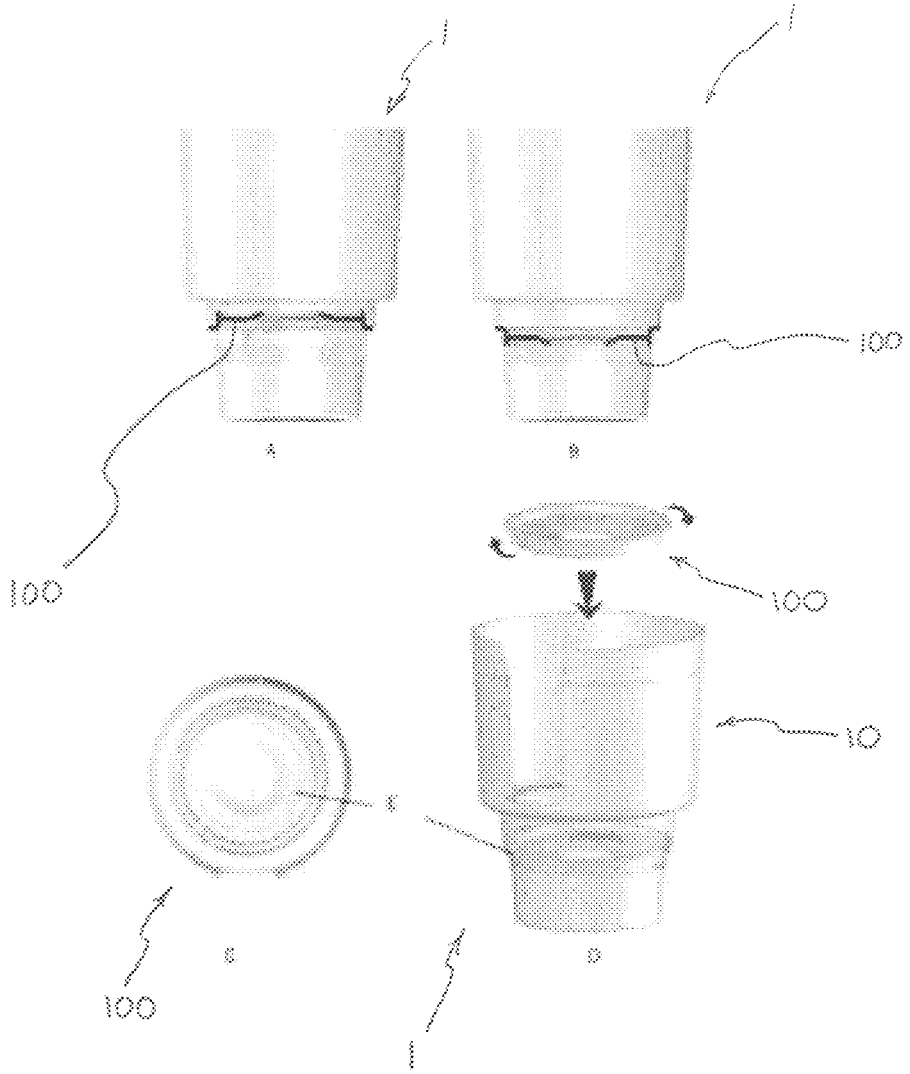
FIG. 29 is a set of four images of a cup holder adaptor assembly in accordance with certain embodiments of the present disclosure.
Figure 30:
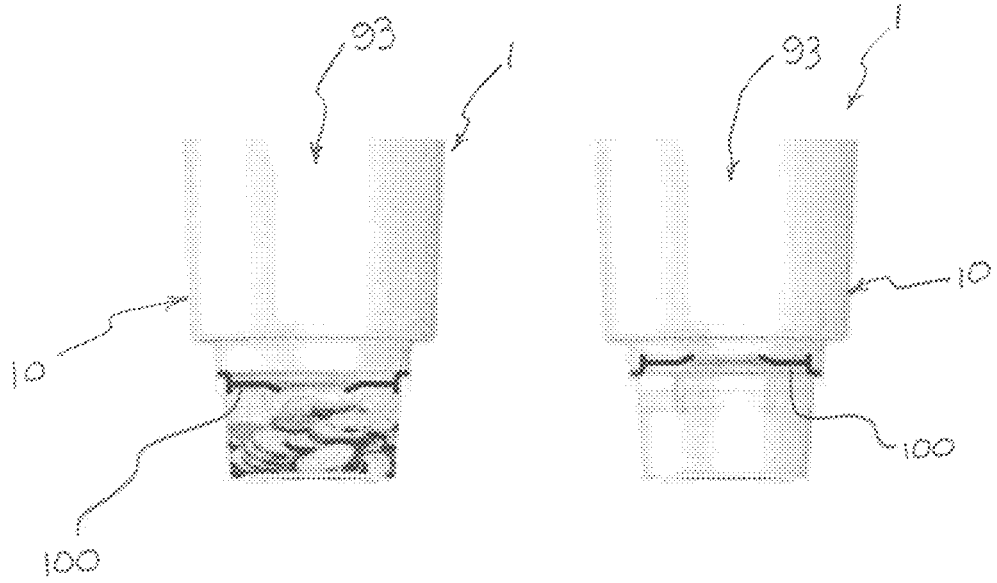
FIG. 30 is a set of two additional images of the cup holder adaptor assembly of FIG. 29.

When the cup deck 100 is mounted removably (i.e., in an operative position) within the portable cup holder 10 (e.g., within the lower section 20 thereof), the resulting storage compartment is configured to receive coins, small pieces of candy, and/or other small items. Reference is made to FIG. 30. At the same time, the so-assembled cup holder adaptor assembly 1 is configured to stably receive any one of a range of cups, cans, and bottles. In more detail, the cup deck 100, when so positioned, preferably has an upwardly-facing side on which the bottom of a cup, can, or bottle can rest stably. Preferably, this upwardly-facing side comprises a substantially planar (or at least generally planar) deck surface. Moreover, the upwardly-facing side and/or its deck surface preferably is substantially horizontal (or at least generally horizontal) and/or substantially parallel (or at least generally parallel) to a base surface 121 of the bottom 21 of the portable cup holder 10. Reference is made to FIGS. 15, 22, 29, 30, 35, and 36B-36D.

The height of the storage compartment preferably is less than 2.5 inches, perhaps less than 2.25 inches, or even less than 2 inches, such as from 1 inch to 2.25 inches, or from 1 inch to 2 inches. It is to be appreciated, however, that the dimensions of the storage compartment can be varied to suit different applications, different intended uses, and different customer preferences.

The portable cup holder 10 is configured to stably receive any one of a range of cups, cans, and bottles. For example, the portable cup holder 10 comprises (and may be defined by) one or more walls 95 bounding an interior space of the portable cup holder. The interior space is configured (together with surfaces of the cup holder wall(s), and in some arrangements, together with a deck surface of the cup deck) to stably receive any one of a range of cups, cans, and bottles.

By referring to the present apparatus as a "cup" holder, it is by no means required that it be used or configured only for holding cups. Rather, it is configured for, and can be used for, holding various cups, cans, bottles, and other liquid receptacles. Moreover, it is to be appreciated that the term cup includes any cup whether or not it has a lid. Thus, the term cup includes, among other types of cups, a drinking glass or a tumbler. Moreover, the term bottle includes water bottles whether or not they have thermally insulative walls or wall cavities, as well as flasks.

The portable cup holder 10 preferably includes both a lower section 20 and an upper section 90. The lower section 20 has a smaller diameter (e.g., a smaller inner diameter and a smaller outer diameter) than the upper section 90. The lower section 20 is configured to be received in the OEM (e.g., built-in) cup receptacle of a vehicle or the like, while the upper section 90 (which has an outer diameter that typically is larger than an inner diameter of the built-in cup holder) is positioned above the OEM cup receptacle. The illustrated upper section 90 extends upwardly and outwardly from the lower section 20. This allows the upper section 90 to receive a relatively large water bottle or another relatively large bottle, cup, or can.

It will be appreciated that the OEM (e.g., built-in) cup receptacle need not be part of a vehicle. Other suitable OEM cup receptacles are found in other items, such as theater seating, home-theatre seating, sofas, recliners, benches, folding chairs, boats, airplanes, and the like. The present cup holder adaptor assembly can be used with any suitable cup receptacle, whether in a vehicle or elsewhere.

The lower section 20 preferably has an inner diameter of less than 3.5 inches, more preferably less than 3.3 inches, or less than 3 inches. In addition, it preferably is greater than 1.75 inches, or greater than 2 inches. In one example, the inner diameter of the lower section 20 is about 2.5 inches. It is to be appreciated, however, that the noted dimensions are by no means limiting. Rather, the dimensions can be varied to suit different applications, different intended uses, and different customer preferences.

The upper section 90 preferably has an inner diameter of greater than 3 inches, more preferably greater than 3.25 inches, and perhaps optimally greater than 3.5 inches. In addition, it preferably is less than 4.5 inches, such as less than 4 inches. In one example, the inner diameter of the upper section 90 is about 3.6-3.625 inches.

In the embodiment illustrated, the upper section 90 tapers outwardly from a minimum inner diameter (which is adjacent the lower section 20) of about 3.2-3.4 inches to a maximum inner diameter (adjacent the top of the portable cup holder) of about 3.55-3.75 inches. Again, the noted dimensions are not limiting: they are just examples. Moreover, the upper section need not be tapered. Instead, the sidewall portion of the wall defining the upper section can simply be vertical.

The upper section 90 of the portable cup holder 10 comprises (e.g., is defined by) a wall 95, which preferably has a slot 93 formed therein. The illustrated slot 93 is formed in a sidewall portion of the wall 95. When provided, the slot 93 is configured to receive a handle of a mug when the mug is rested stably in the portable cup holder 10. For example, when the cup deck 100 is mounted removably (e.g., in an operative position) within the portable cup holder 10 (e.g., within the lower section 20 thereof), an upwardly-facing side of the cup deck (and/or an annular circumferential floor section 92) is configured to stably receive the bottom of a mug while a handle of the mug projects through the slot. In embodiments of this nature, the cup holder adaptor assembly 1 is configured to stably receive any one of a range of mugs, cups, cans, and bottles. It is to be appreciated, however, that the slot can be omitted in certain embodiments.

The portable cup holder 10 can optionally be a single integral piece. In such cases, the single integral piece defines the wall 95/the entire portable cup holder 10. It is to be appreciated, however, that the portable cup holder can alternatively be formed collectively by two or more pieces assembled (e.g., joined) together. For example, a first piece can define the lower section while a second piece defines an upper section.

If desired, the lower section of the portable cup holder can be equipped with an optional band that is slidable upwardly and downwardly along the lower section, e.g., so as to adjust an effective outer diameter of the lower section. When provided, this can advantageously allow the lower section of the portable cup holder to fit more snuggly in certain OEM (e.g., built-in) cup receptacles.

The portable cup holder 10 and the cup deck 100 preferably comprise, consist of, or consist essentially of polymer. If desired, the portable cup holder 10 and the cup deck 100 can comprise, consist of, or consist essentially of metal. Moreover, various composites can be used. In some cases, the portable cup holder 10 and the cup deck 100 are formed of the same material (e.g., the same polymer or composite).

The lower section 20 of the portable cup holder 10 can optionally include both a bottom portion 22 and an intermediate portion 28. When provided, the intermediate portion 28 of the lower section 20 is located between the bottom portion 22 of the lower section 20 and the upper section 90 of the portable cup holder 10. In the embodiment illustrated, the bottom portion 22 of the lower section 20 has a smaller diameter (e.g., a smaller outer diameter) than the intermediate portion 28 of the lower section. In such embodiments, the upper section 90 preferably has a larger diameter (e.g., a larger outer diameter) than the intermediate portion 28 of the lower section.

In the embodiment illustrated, the bottom portion 22 preferably has an inner diameter of less than three inches, less than 2.75 inches, or even less than 2.6 inches, such as 2.5 inches. In addition, the intermediate portion 28 of the illustrated lower section 20 preferably has an inner diameter of greater than 2.5 inches and less than 3.5 inches, or greater than 2.5 inches and less than 3.25 inches, such as 3 inches.

Figure 2:
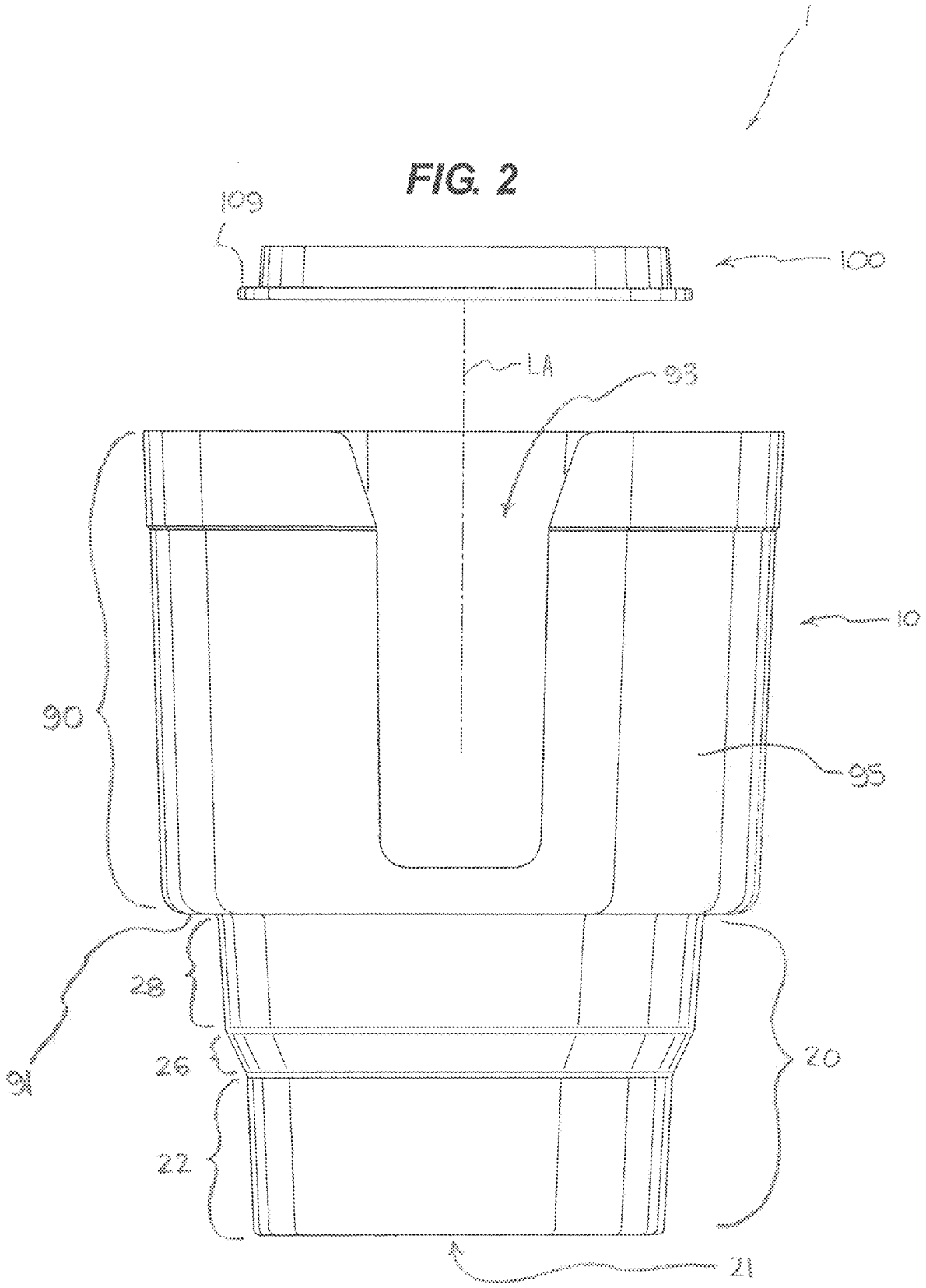
FIG. 2 is an exploded front view of the cup holder adaptor assembly of FIG. 1.
Figure 3:
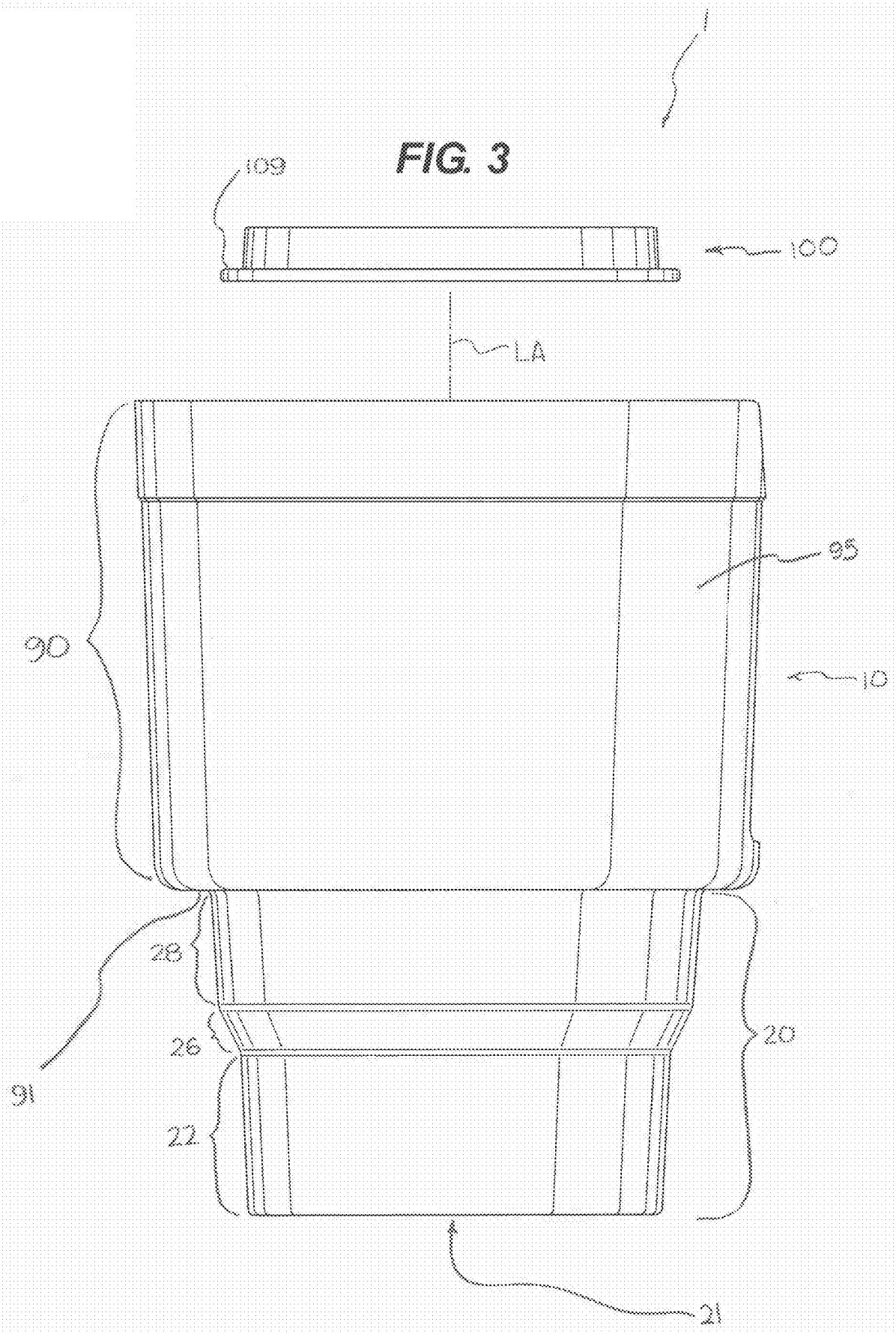
FIG. 3 is an exploded right side view of the cup holder adaptor assembly of FIG. 1.
Figure 4:
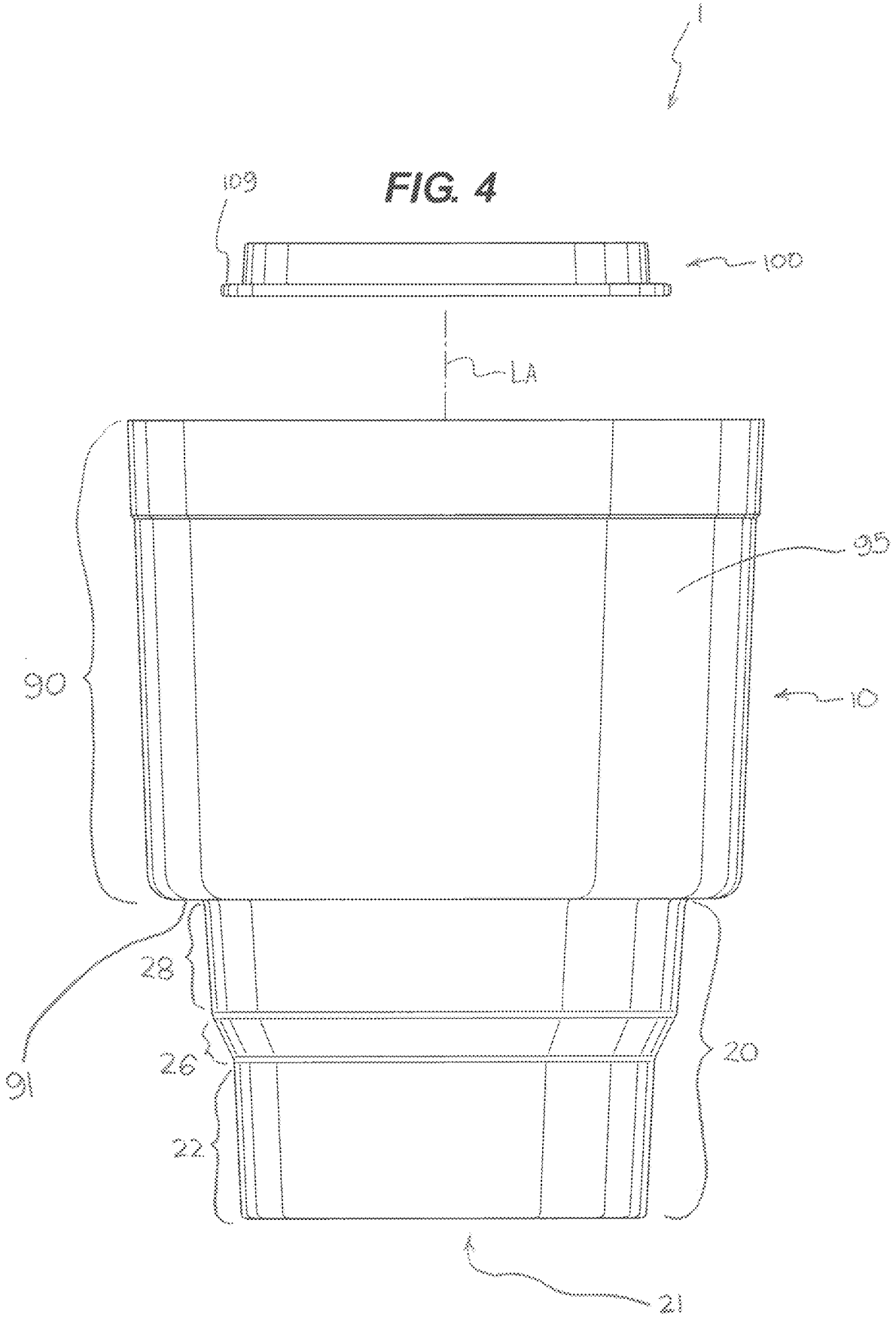
FIG. 4 is an exploded rear view of the cup holder adaptor assembly of FIG. 1.
Figure 5:
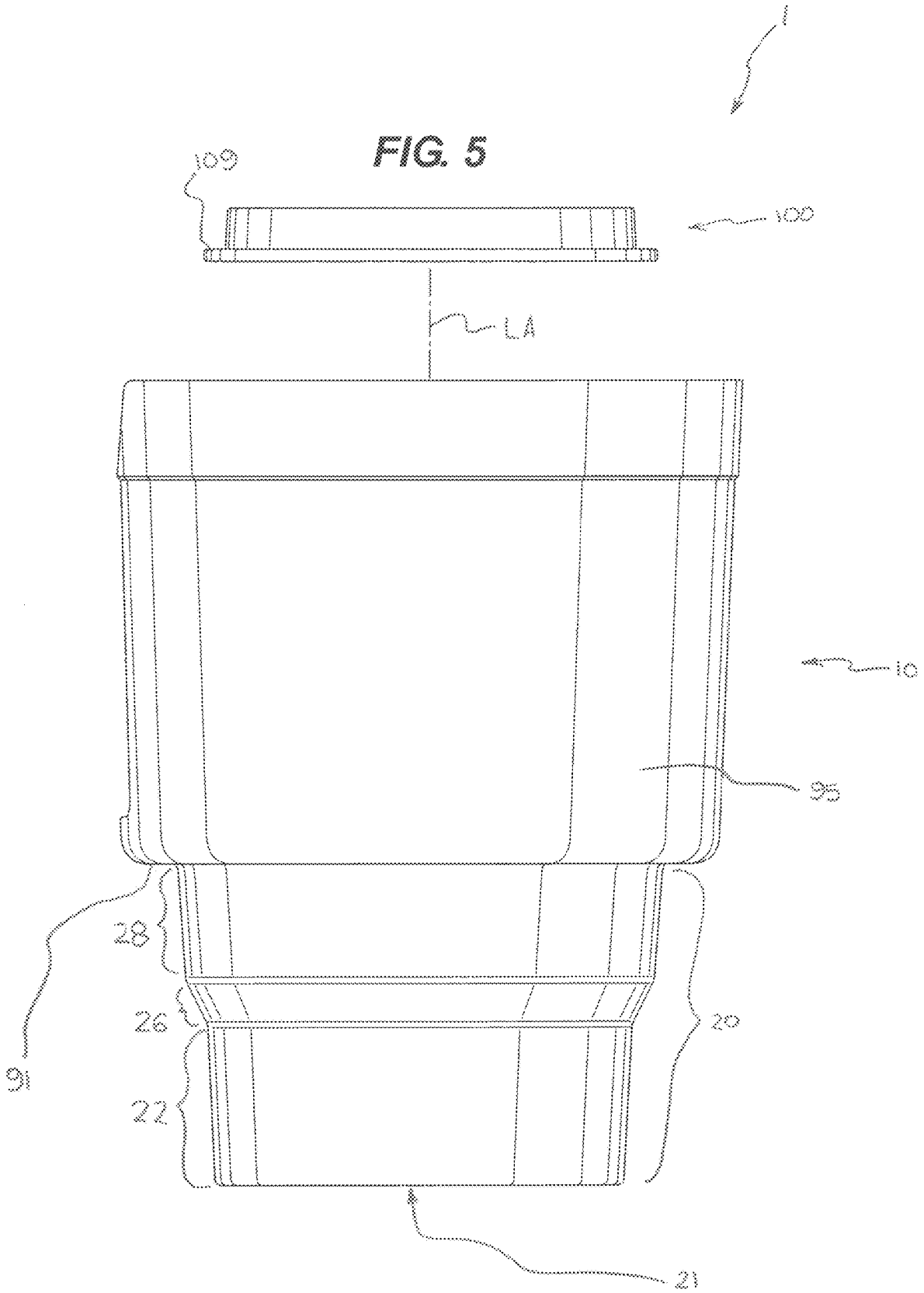
FIG. 5 is an exploded left side view of the cup holder adaptor assembly of FIG. 1.
Figure 6:
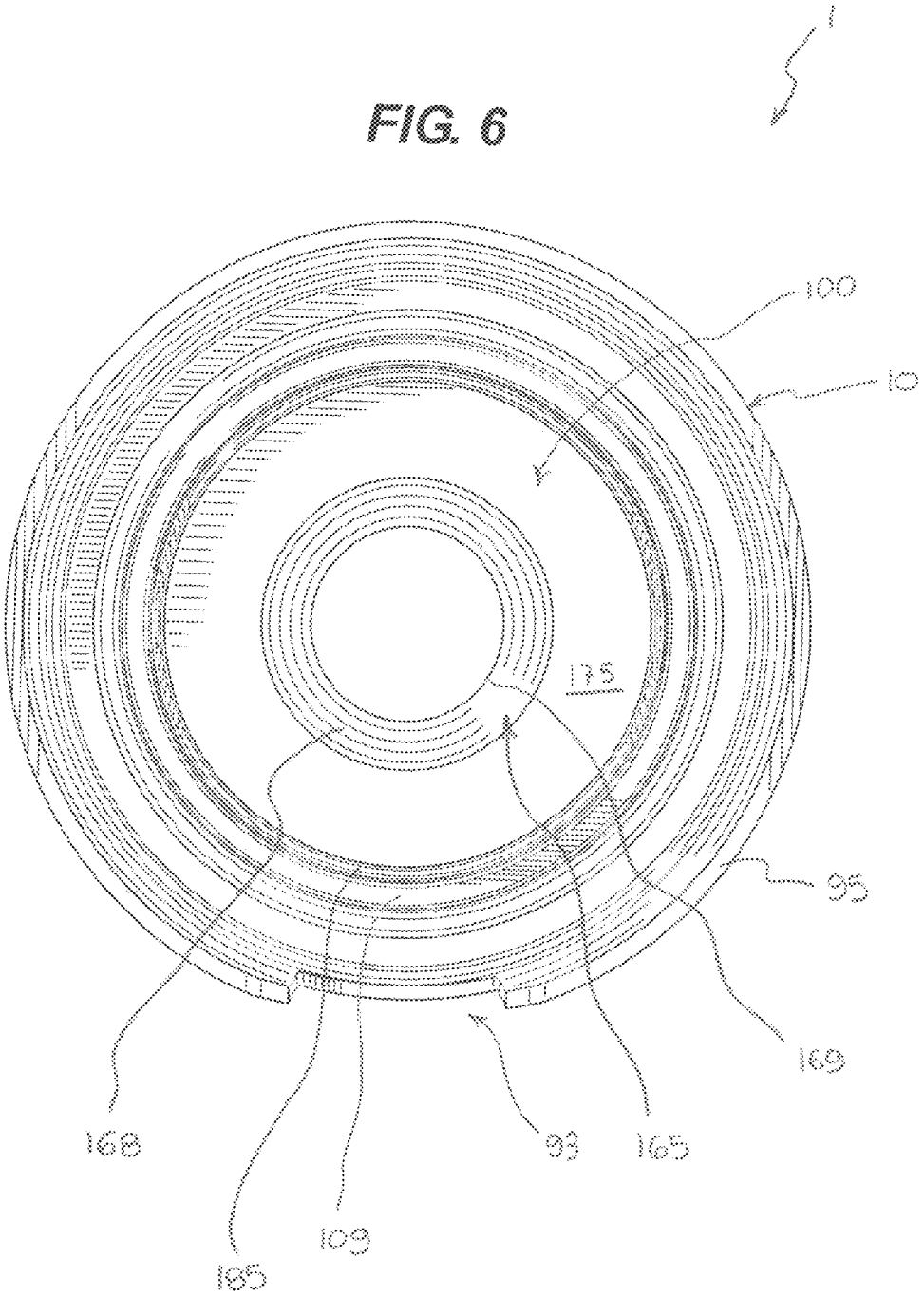
FIG. 6 is a top view of the cup holder adaptor assembly of FIG. 1.
Figure 7:
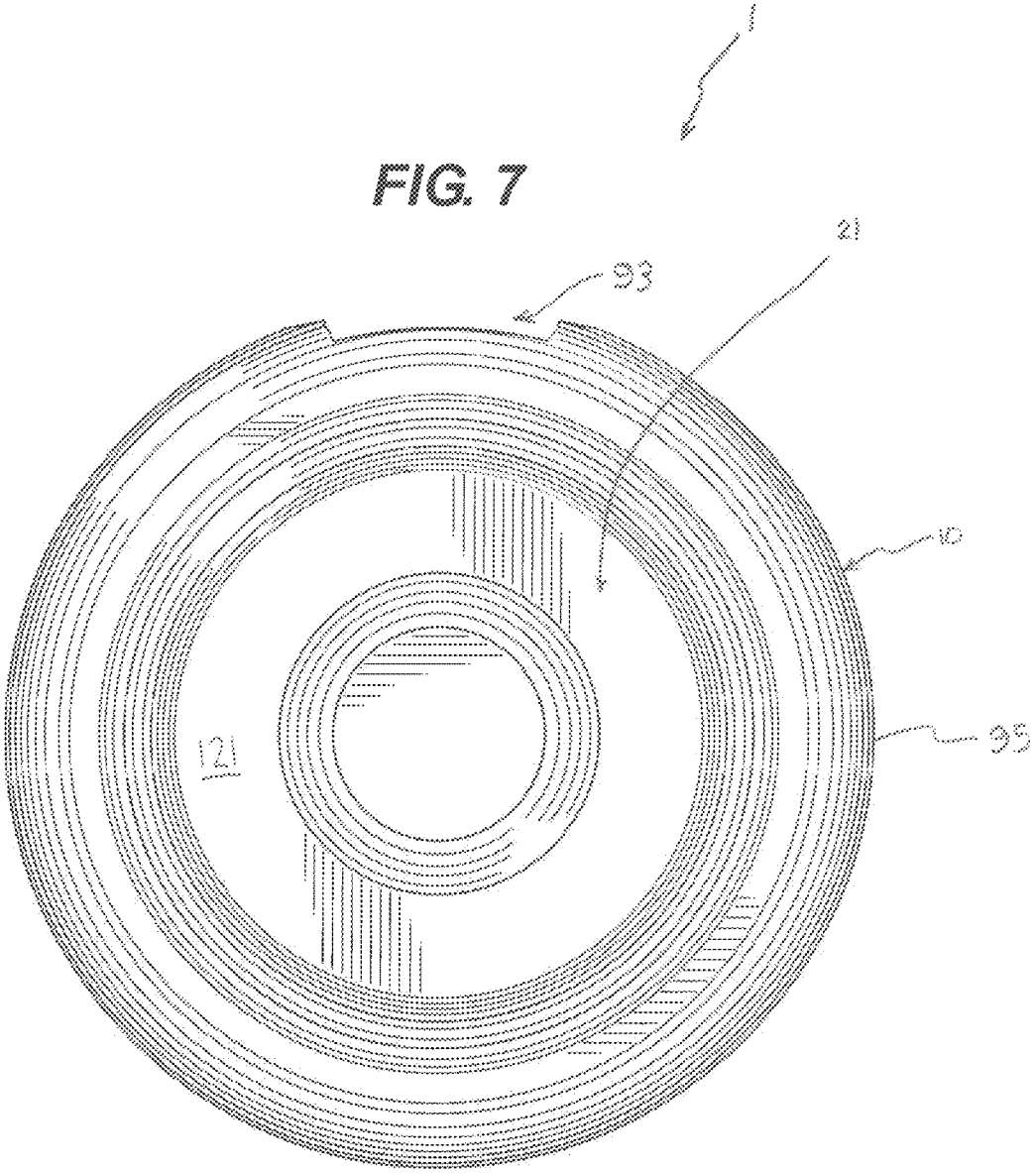
FIG. 7 is a bottom view of the cup holder adaptor assembly of FIG. 1.

In some cases, the lower section 20 of the portable cup holder 10 further includes a tapered portion 26 between the intermediate 28 and bottom 22 portions of the lower section 20. Reference is made to FIG. 2. Here, the tapered portion 26, in extending from the intermediate portion 28 to the bottom portion 22, tapers from a larger outer diameter to a smaller outer diameter. In other cases, the whole lower section of the portable cup holder simply has the same outer diameter.

The portable cup holder 10 preferably includes one or more shoulders 75 that receive the cup deck 100 when the cup deck is mounted (e.g., in an operative position) within the portable cup holder 10 (e.g., within the lower section 20 thereof). As noted above, the portable cup holder 10 comprises a wall 95 bounding an interior space of the portable cup holder. The wall 95 preferably has one or more shoulders 75 that receive the cup deck 100 when the cup deck is mounted within the portable cup holder 10. In the embodiment illustrated, the one or more shoulders 75 are a plurality of shoulders 75 defined respectively by a plurality of ribs (or gussets) 70. The ribs 75 preferably are spaced circumferentially apart from one another about an interior of the wall 95. The number and shape of the ribs (or gussets) can be varied as desired. In some cases, 3-8 (e.g., 6) ribs are provided. Furthermore, instead of ribs, a single shelf extending entirely about an inner circumference of the wall can define a continuous shoulder (or ledge) that receives the cup deck when the cup deck is mounted within the portable cup holder.

Thus, the portable cup holder 10 can optionally include a plurality of upstanding ribs 70 projecting from an interior side of the lower section 20. When provided, the upstanding ribs 70 can optionally project from an interior side of the tapered portion 20. In the embodiment illustrated, each rib 70 projects from the interior side of both the tapered portion 20 and the intermediate portion 28. As noted above, however, in other embodiments the entire lower section has the same diameter, in which case one or more shoulders can simply be provided partway up the lower section so as to provide a seat for the cup deck. As another option, the one or more shoulders (or another structure defining the seat for the cup deck) can be located in the upper section (e.g., a bottom area of the upper section) of the portable cup holder. In such cases, the entire lower section of the portable cup holder may be part of the storage compartment.

Preferably, the cup deck 100 is disc shaped. In addition, it preferably has a circumferential outer rim 109, e.g., such that one or more shoulders 75 of the portable cup holder 10 receive the circumferential outer rim 109 when the cup deck 100 is mounted (e.g., in an operative position) within the portable cup holder 10 (e.g., within the lower section 20 thereof).

The cup deck 100 preferably has a central opening 150 sized to allow coins to pass therethrough. The illustrated central opening 150 is circular, although this is not required. If desired, the central opening can alternatively be polygonal (square, pentagonal, etc.), oval-shaped, or slot-shaped. If desired, the opening in the cup deck can be omitted. It is to be appreciated that the central opening 150, when provided, is also configured allow small pieces of candy and the like to pass therethrough. Moreover, it allows a person to readily grab and remove the illustrated cup deck 100 from an operative position within the portable cup holder 10 by facilitating the person inserting a finger through the opening and pulling the cup deck upwardly, out of the portable cup holder 10. In a similar manner, the central opening 150, when provided, can also facilitate a person positioning the cup deck 100 in an operative position within the portable cup holder 10 by allowing them to insert a finger through the opening to help them hold and manipulate the cup deck.

In the embodiment illustrated, the cup holder adaptor assembly 1 is configured such that the cup deck 100 can be selectively mounted within the portable cup holder 10 (e.g., within the lower section 20 thereof) in either of two configurations (or "orientations"). The two configurations are referred to herein as a first configuration and a second configuration. Reference is made to FIGS. 29 and 30.

In FIG. 29, image A shows the cup deck 100 mounted in the first configuration within the portable cup holder 10. In FIG. 30, the second image (i.e., the image on the right) shows the cup deck 100 mounted, in the first configuration, within the lower section 20 of the portable cup holder 10. In contrast, image B of FIG. 29, shows the cup deck 100 mounted in the second configuration within the portable cup holder 10. And in FIG. 30, the first image (i.e., the image on the left) shows the cup deck 100 mounted in the second configuration within the lower section 20 of the portable cup holder 10. More will be said of this later.

The cup deck 100 has opposed first and second sides, and the first side preferably has a different configuration than the second side. This is perhaps best appreciated by comparing FIG. 1 with FIG. 8.

Figure 8:
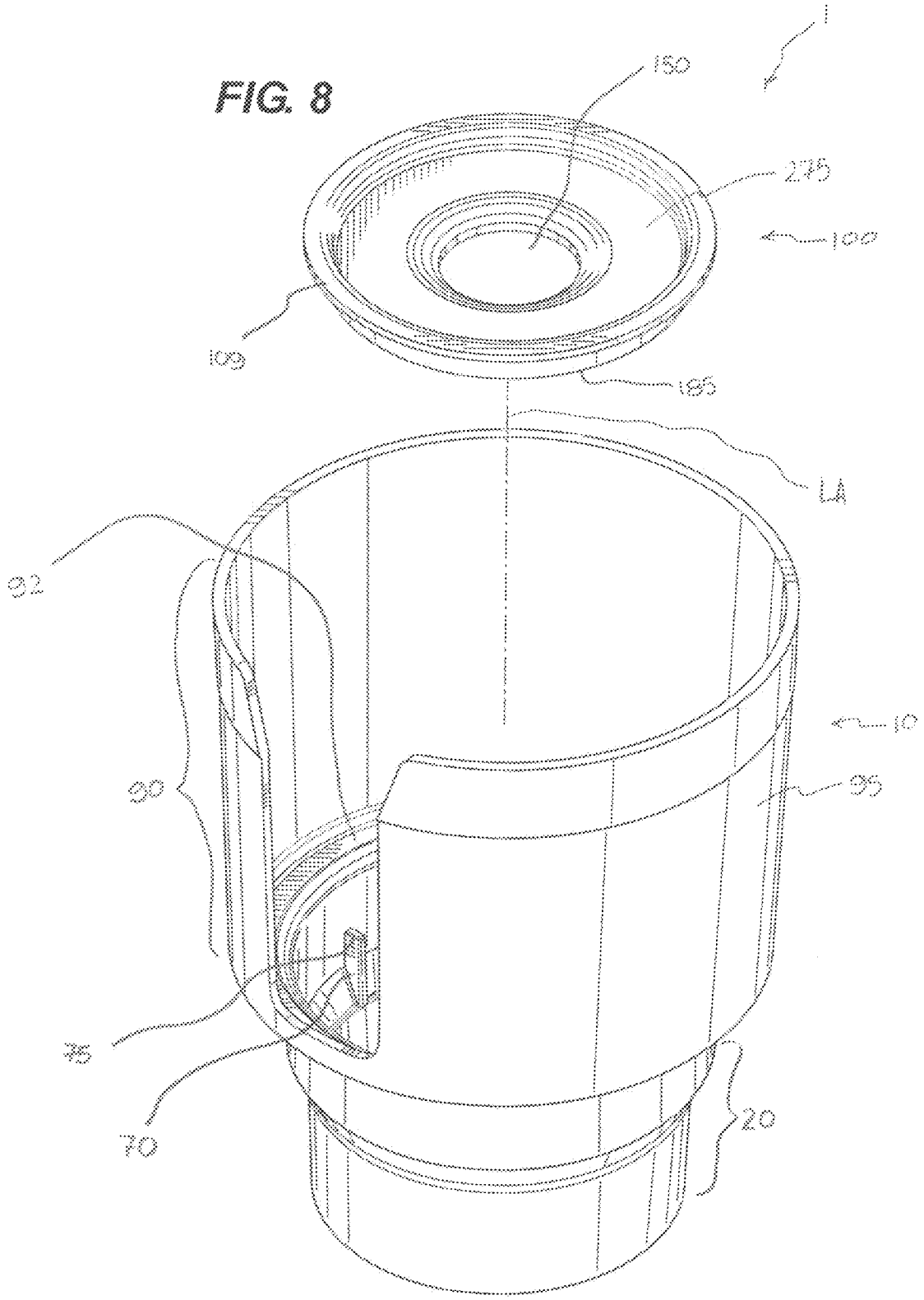
FIG. 8 is an exploded perspective view of the cup holder adaptor assembly of FIG. 1, with the cup deck in a second configuration.
Figure 9:
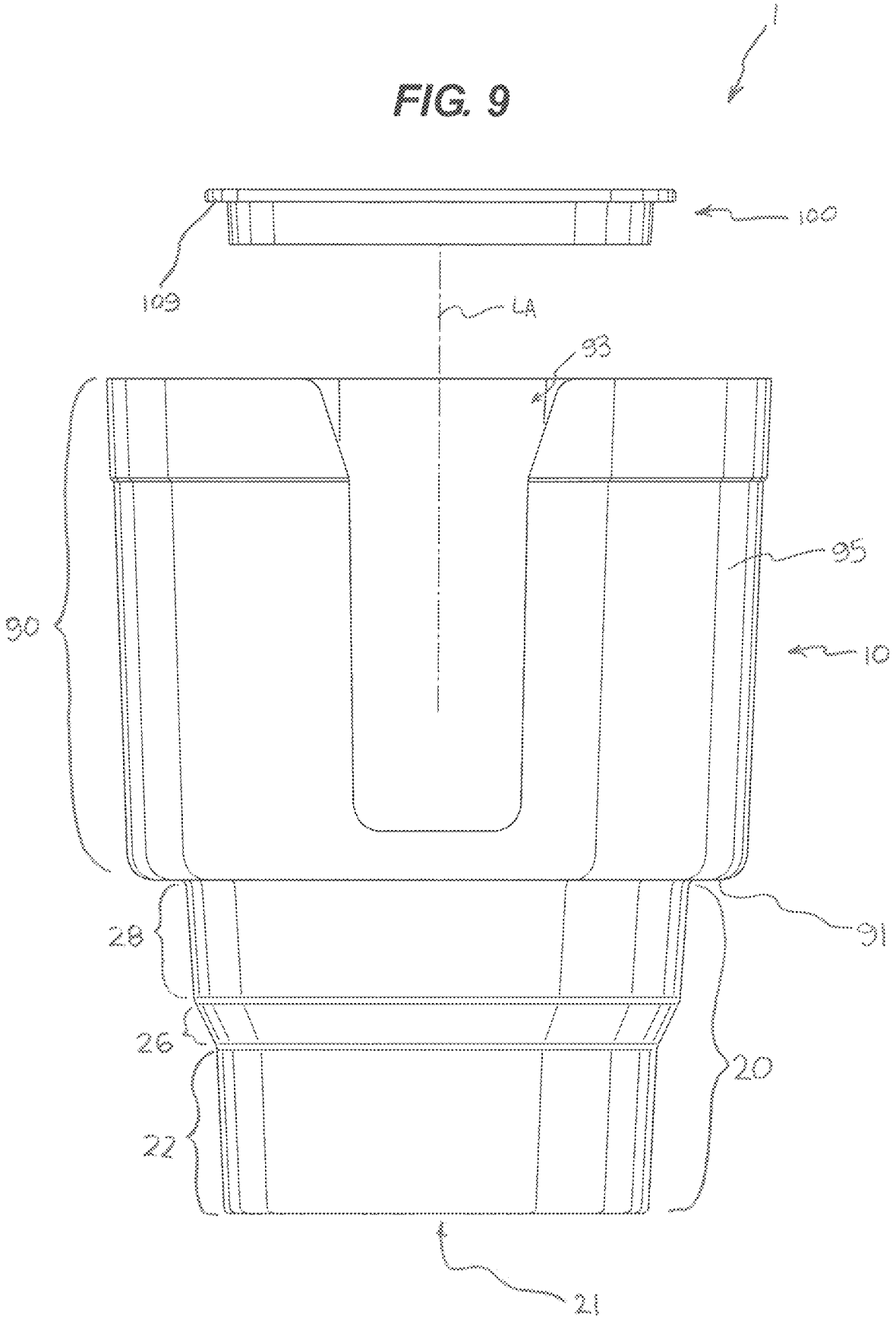
FIG. 9 is an exploded front view of the cup holder adaptor assembly of FIG. 8.
Figure 10:
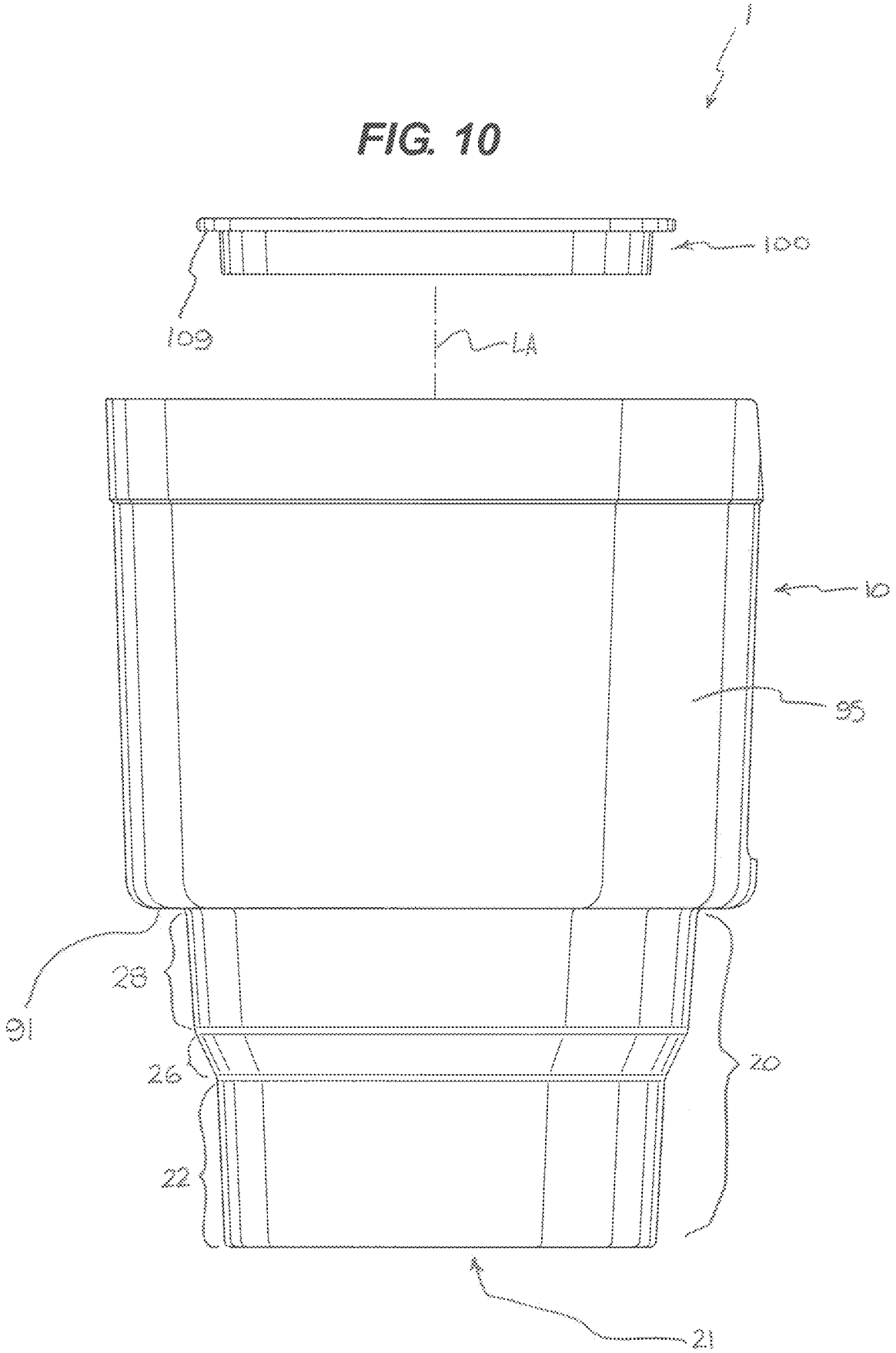
FIG. 10 is an exploded right side view of the cup holder adaptor assembly of FIG. 8.
Figure 11:
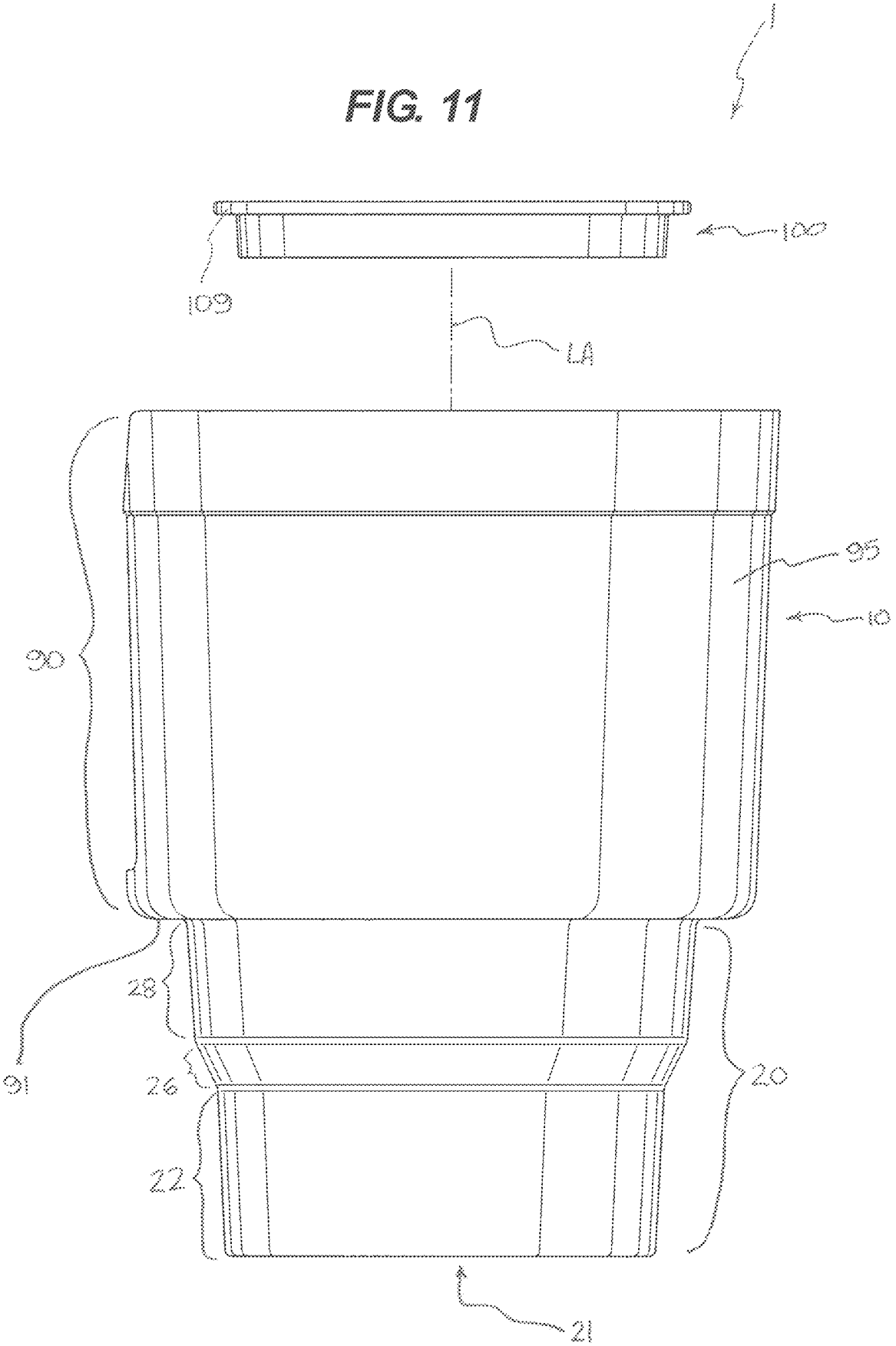
FIG. 11 is an exploded left side view of the cup holder adaptor assembly of FIG. 8.
Figure 12:
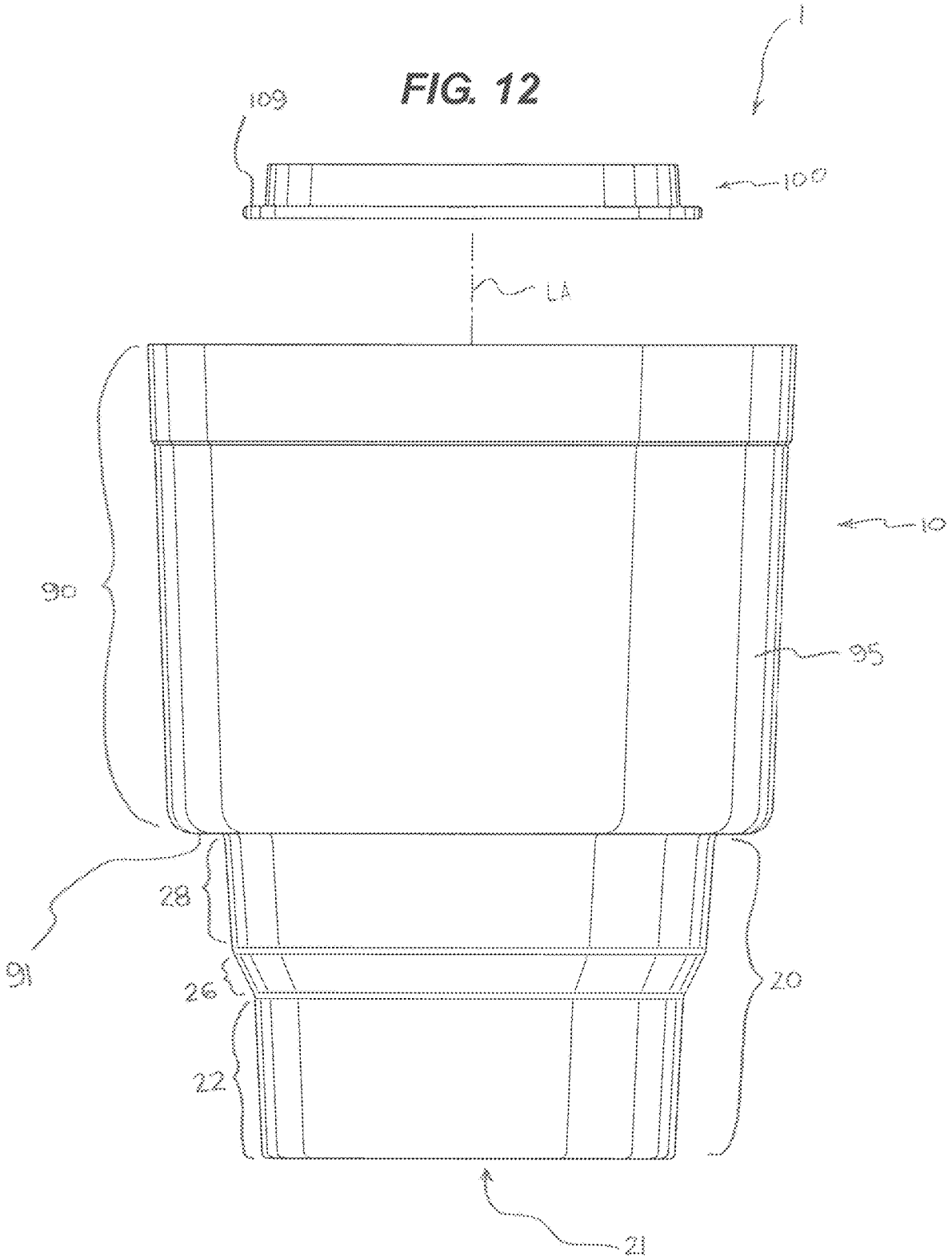
FIG. 12 is an exploded rear view of the cup holder adaptor assembly of FIG. 8.
Figure 13:
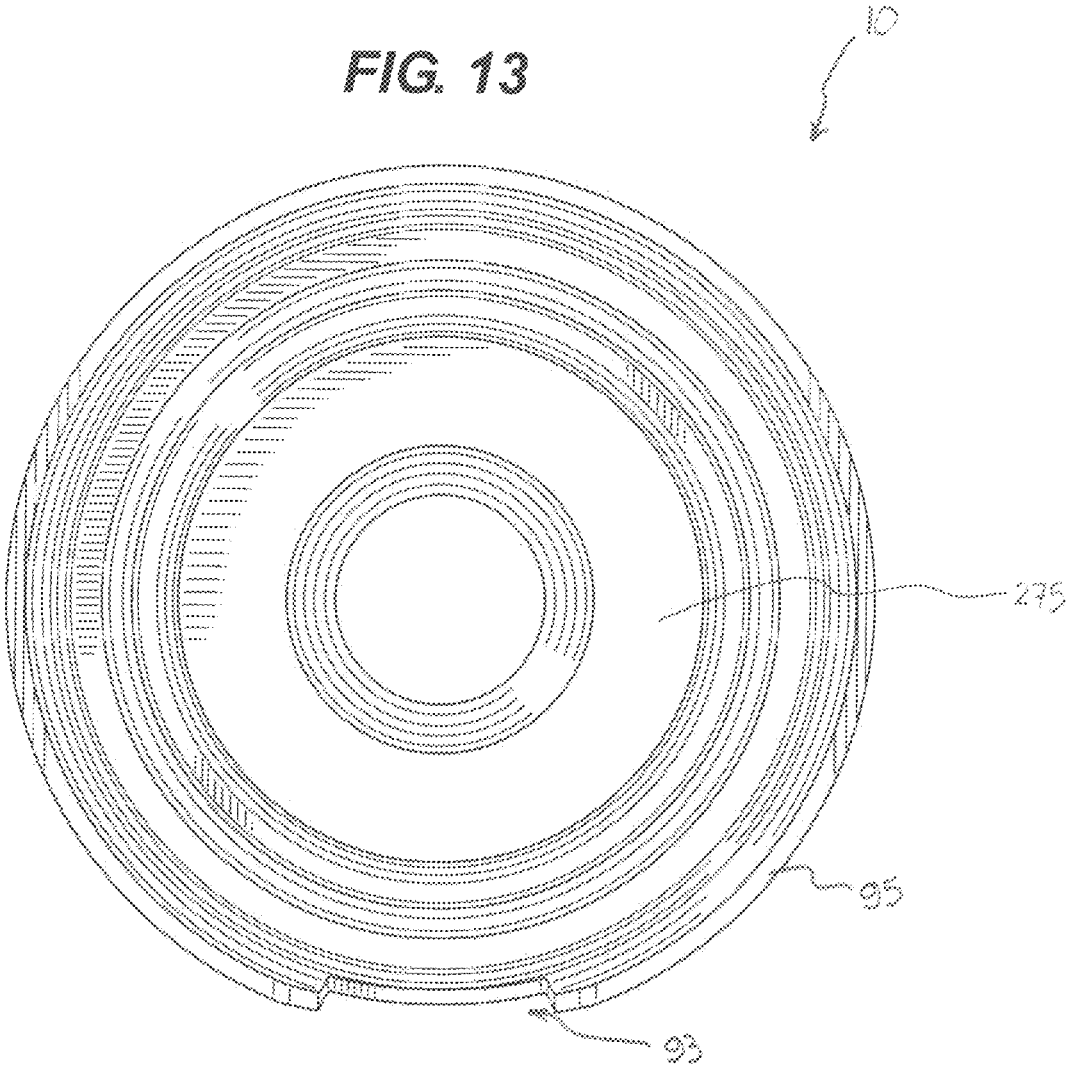
FIG. 13 is a top view of the cup holder adaptor assembly of FIG. 8.
Figure 14:
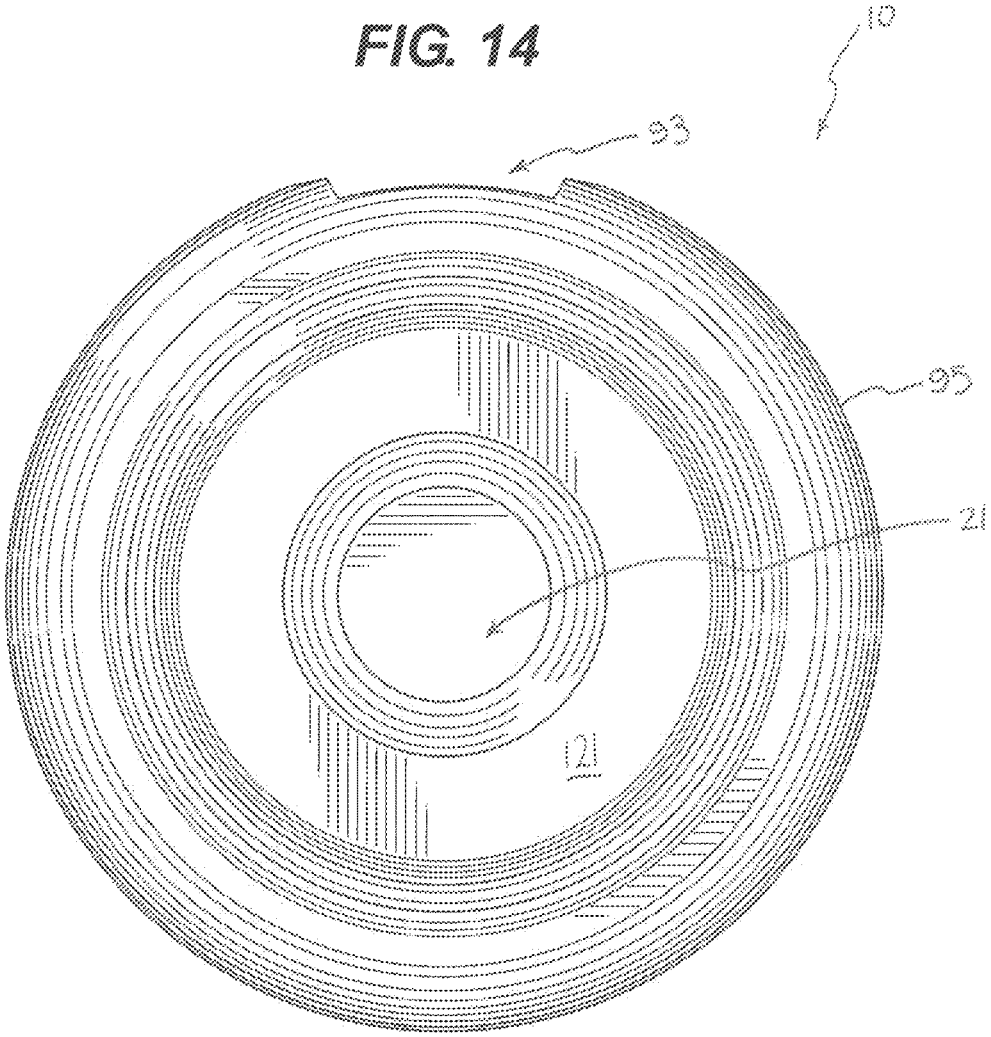
FIG. 14 is a bottom view of the cup holder adaptor assembly of FIG. 8.
Figure 15:
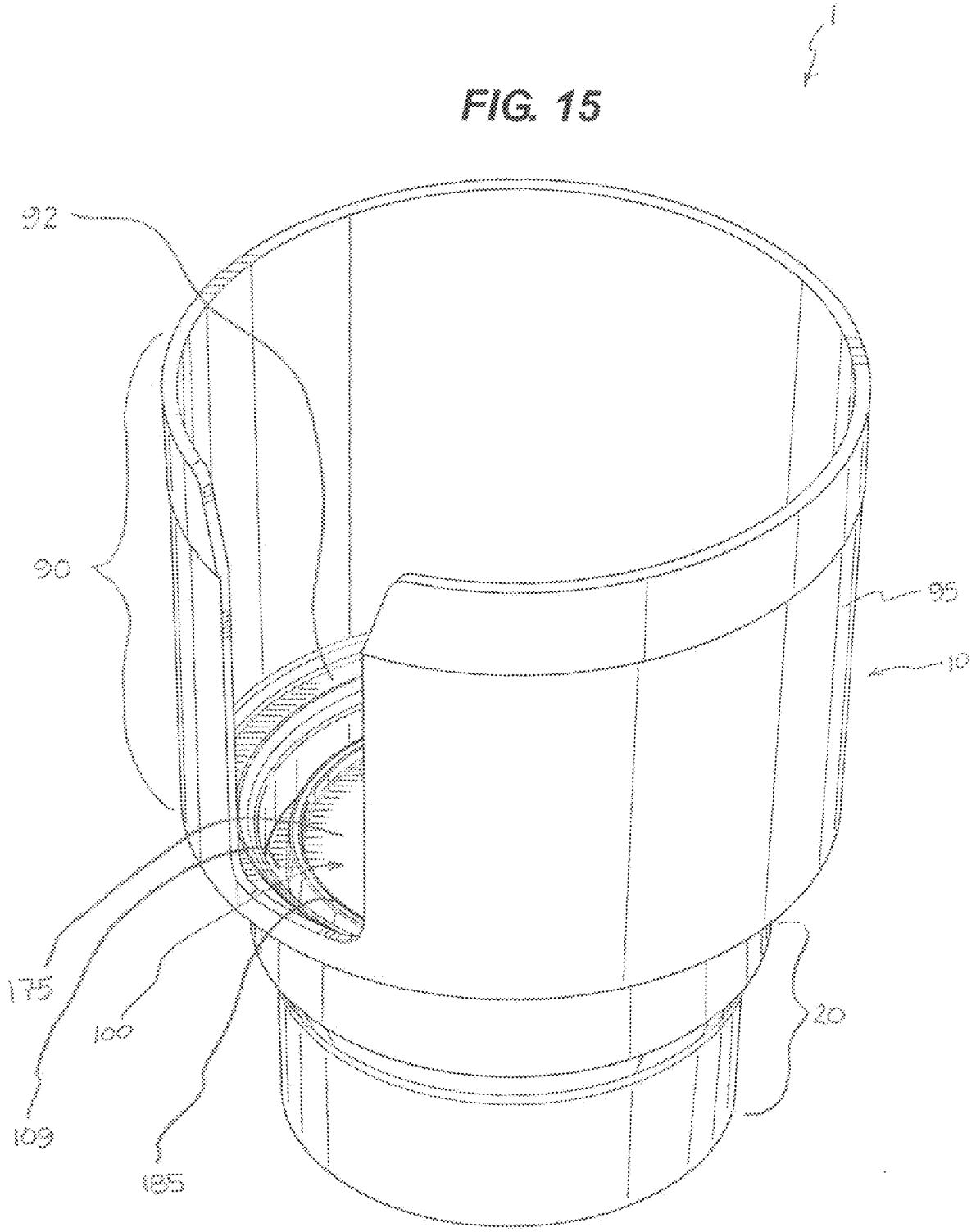
FIG. 15 is a perspective view of the cup holder adaptor assembly of FIG. 1, with the cup deck operatively positioned in the first configuration.
Figure 16:
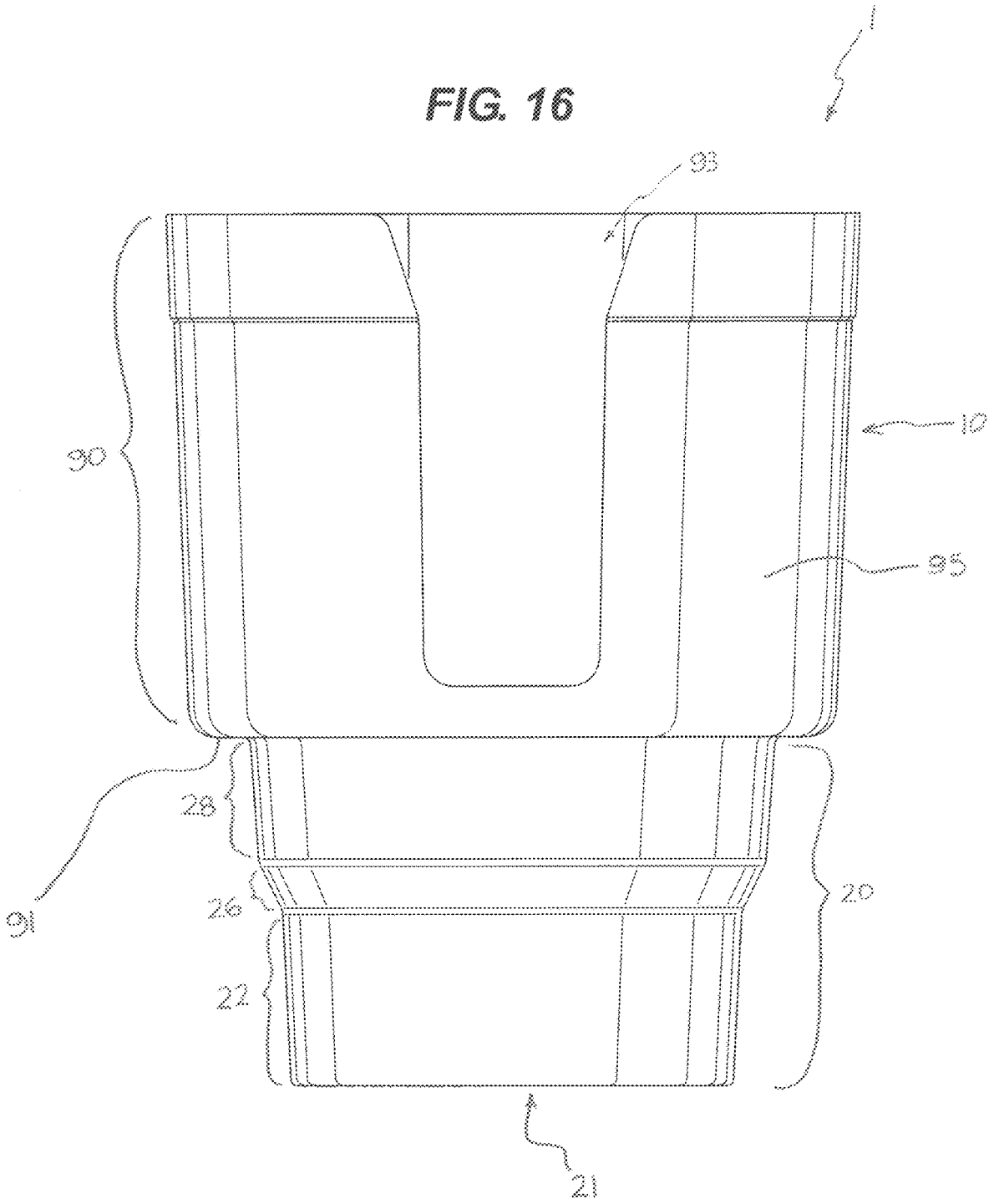
FIG. 16 is a front view of the cup holder adaptor assembly of FIG. 15.
Figure 17:
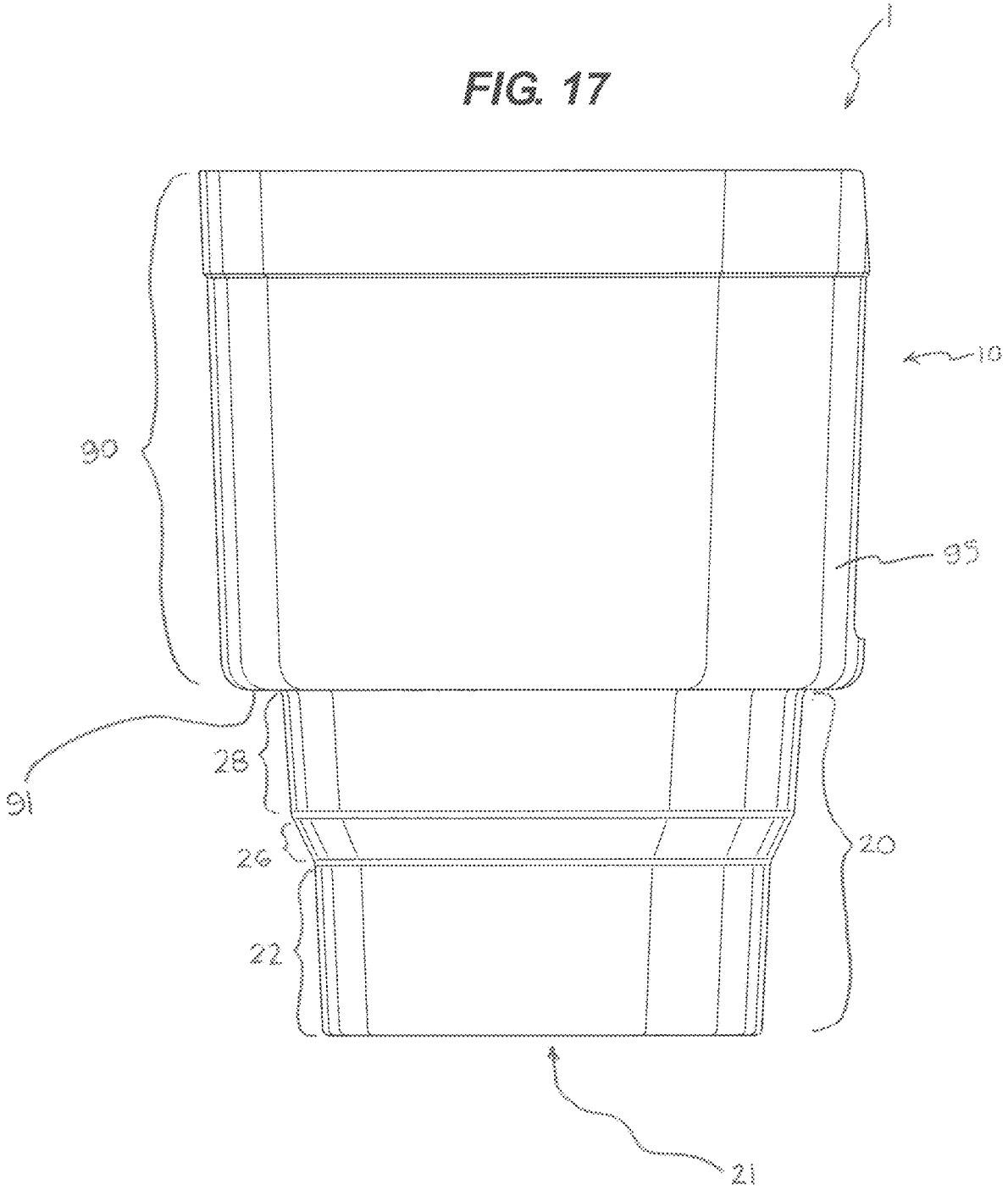
FIG. 17 is a right side view of the cup holder adaptor assembly of FIG. 15.
Figure 18:
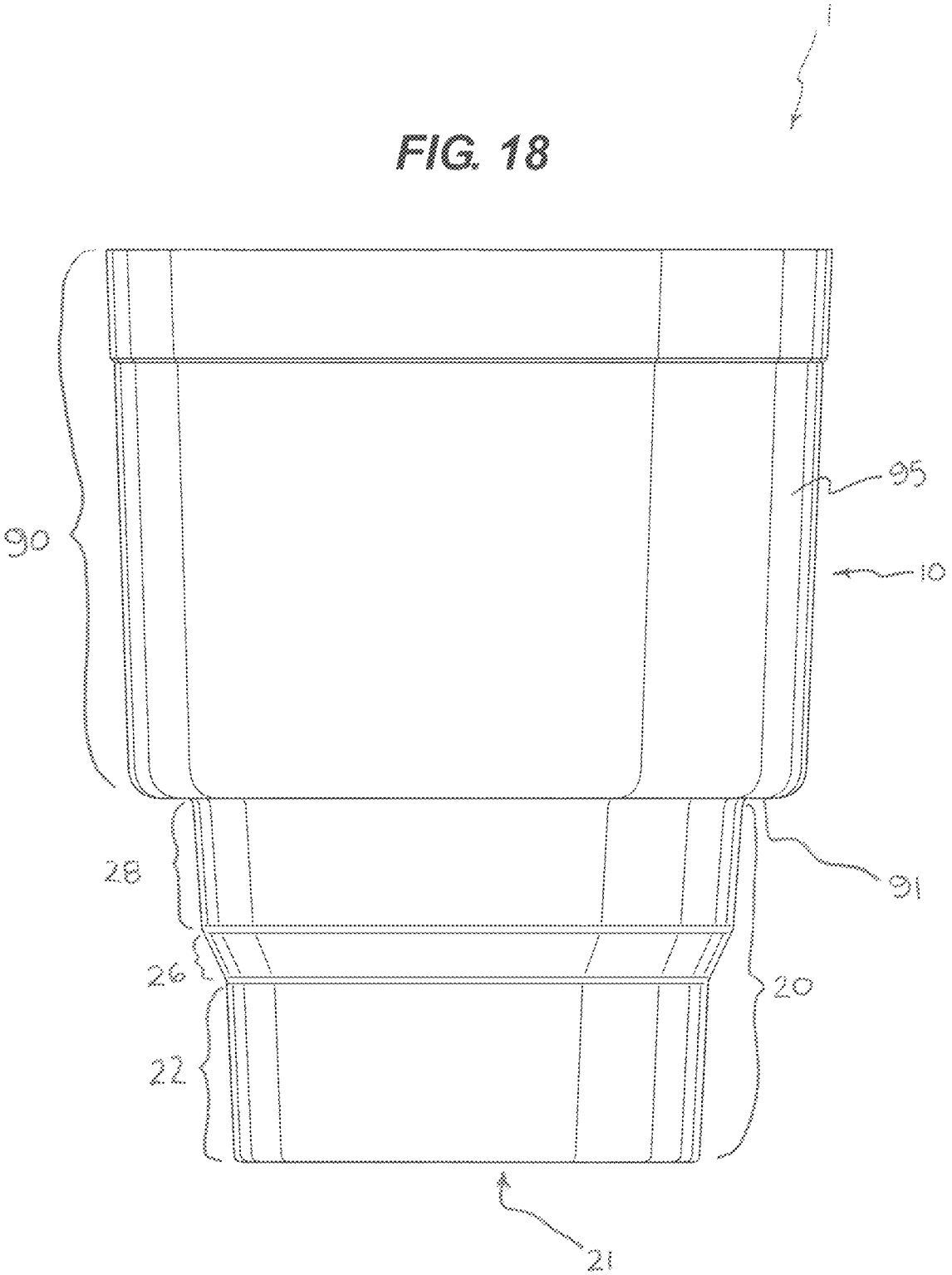
FIG. 18 is a rear view of the cup holder adaptor assembly of FIG. 15.
Figure 19:
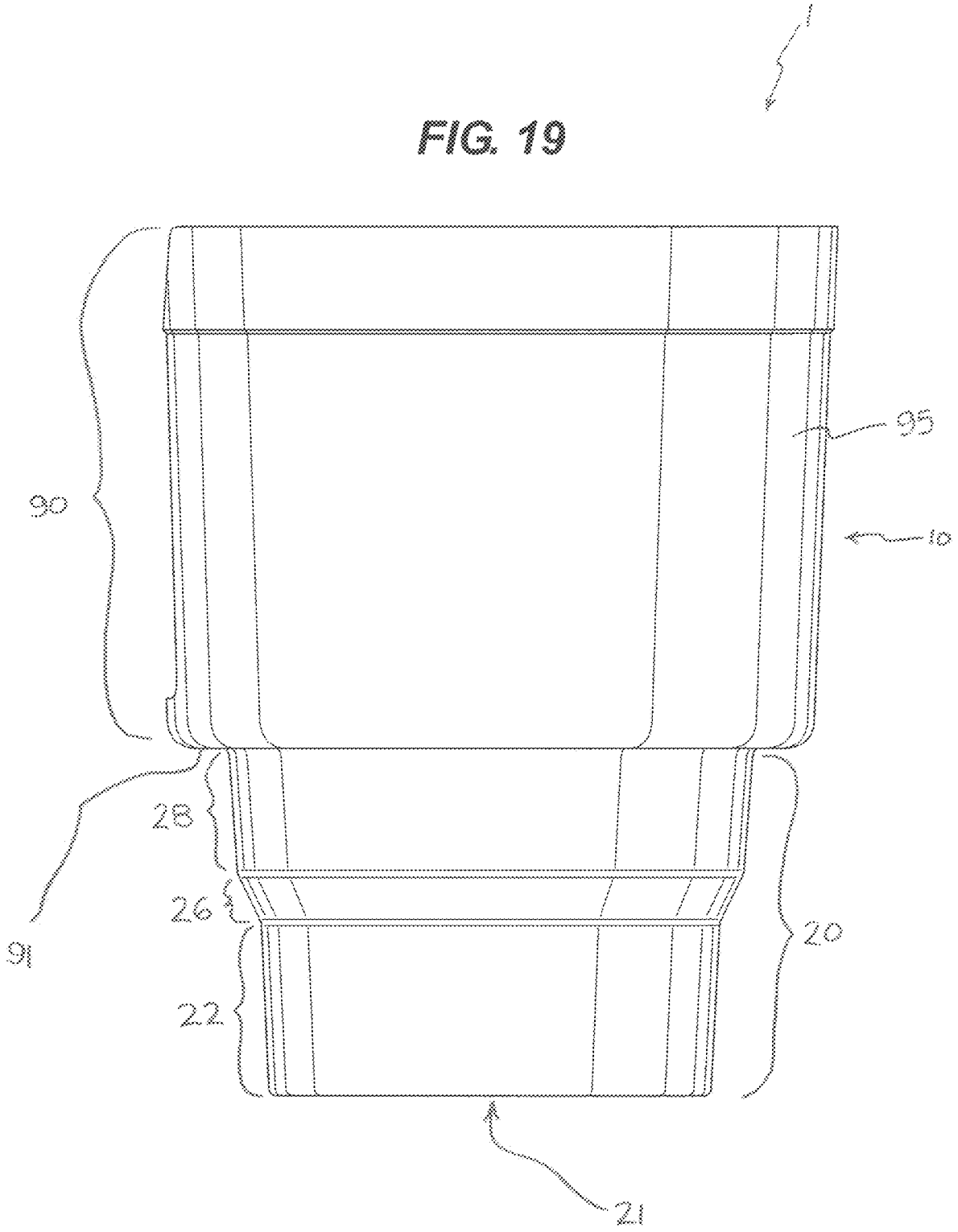
FIG. 19 is a left side view of the cup holder adaptor assembly of FIG. 15.
Figure 20:
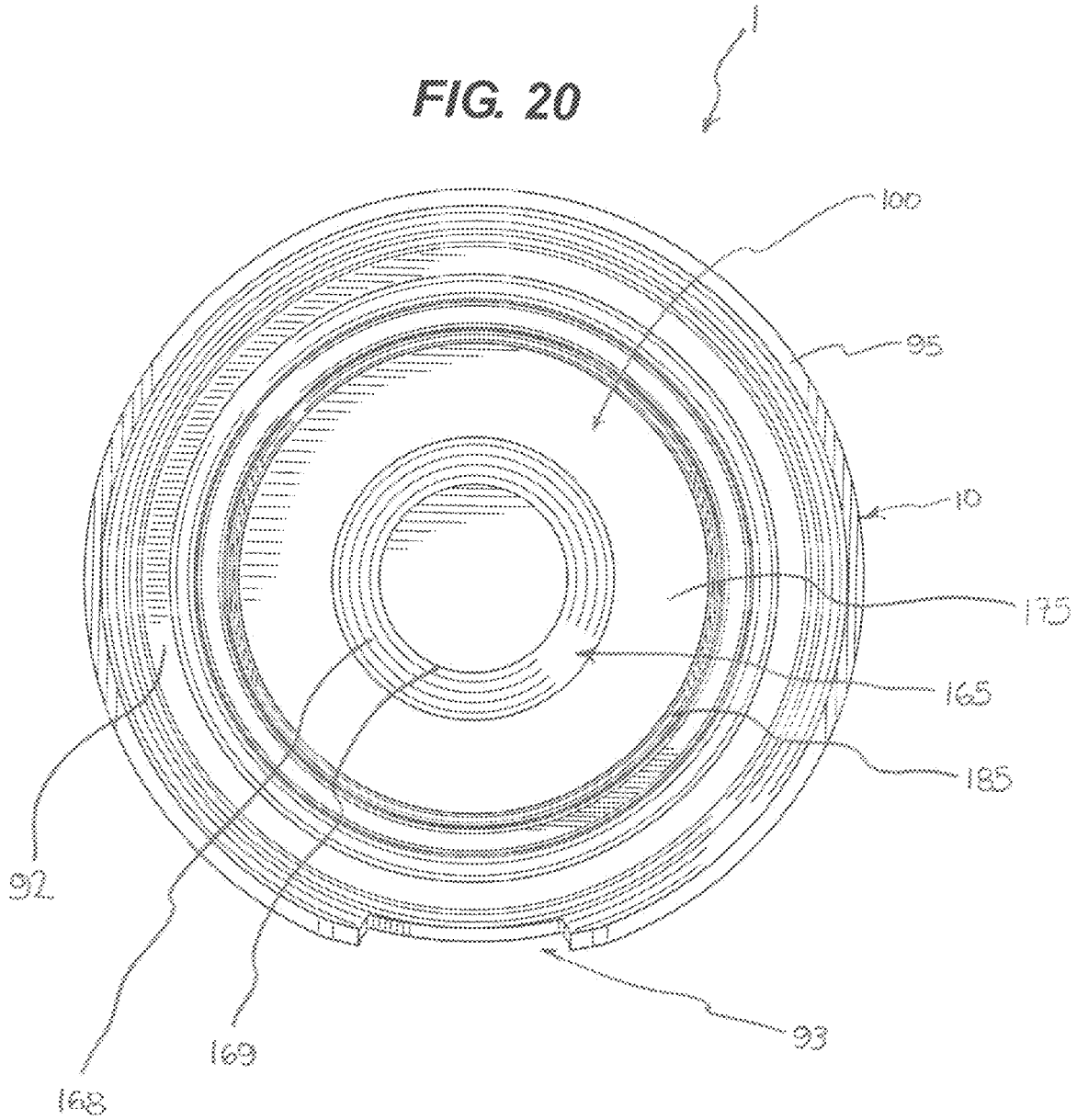
FIG. 20 is a top view of the cup holder adaptor assembly of FIG. 15.
Figure 21:
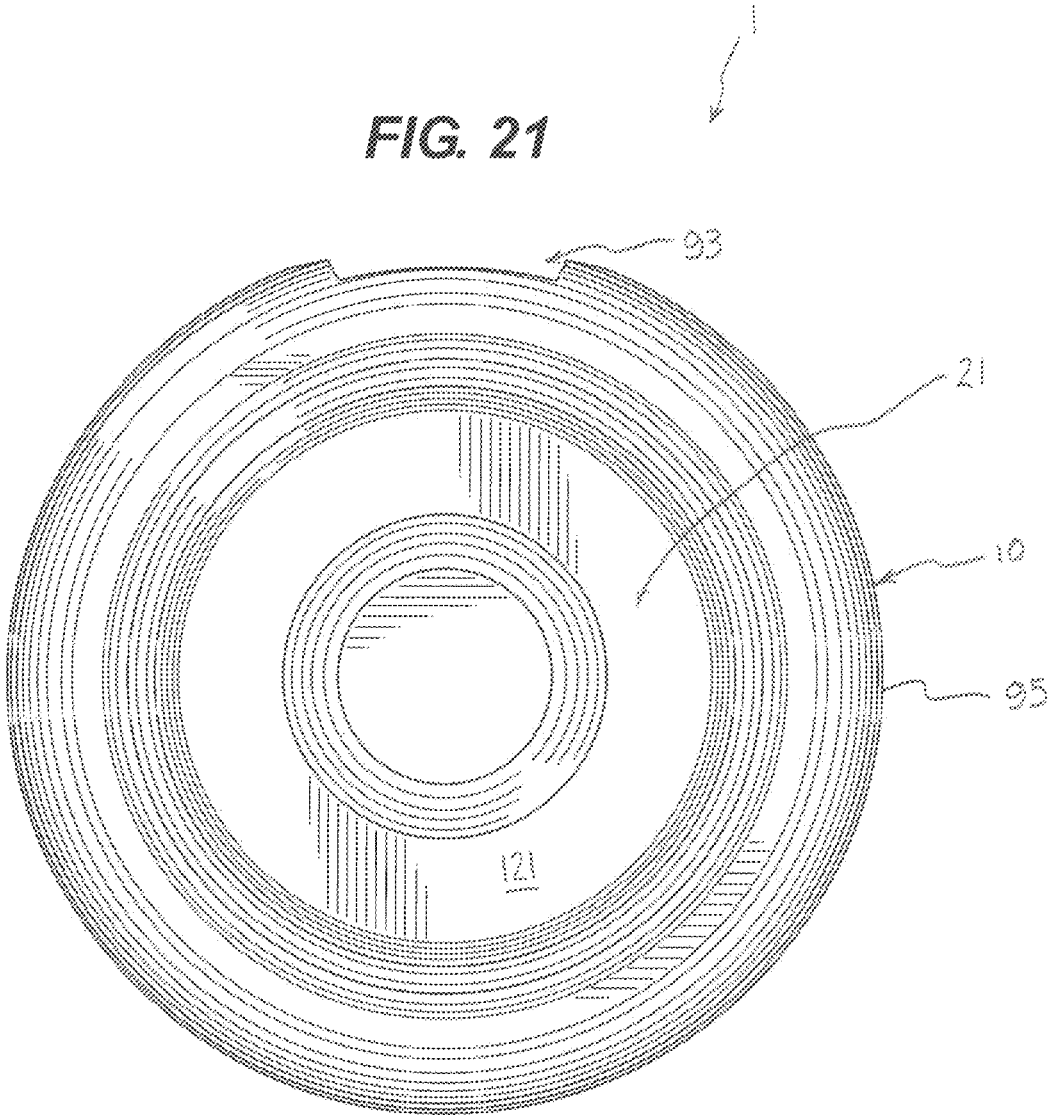
FIG. 21 is a bottom view of the cup holder adaptor assembly of FIG. 15.
Figure 22:
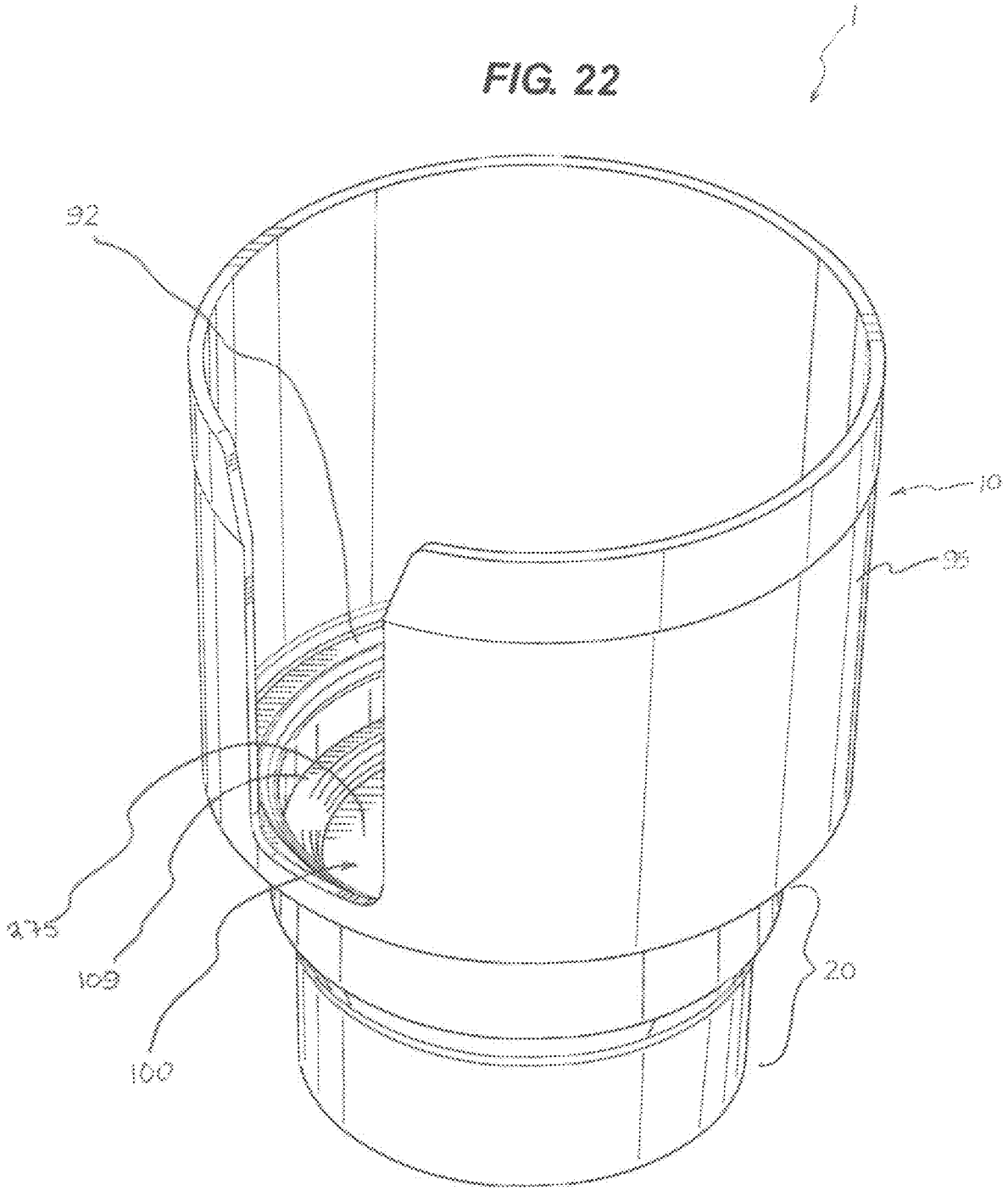
FIG. 22 is a perspective view of the cup holder adaptor of FIG. 8, with the cup deck operatively positioned in the second configuration.
Figure 23:
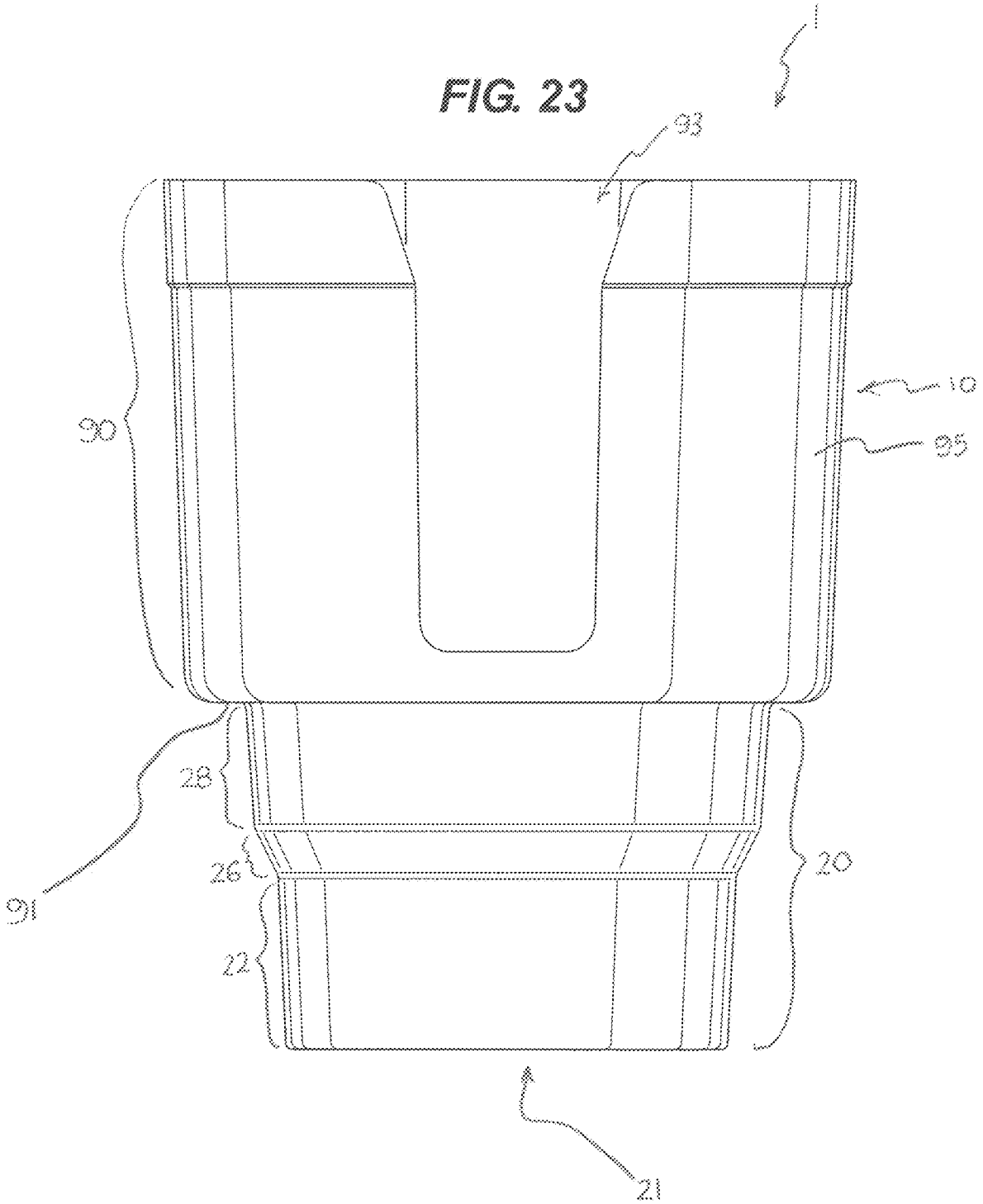
FIG. 23 is a front view of the cup holder adaptor assembly of FIG. 22.
Figure 24:
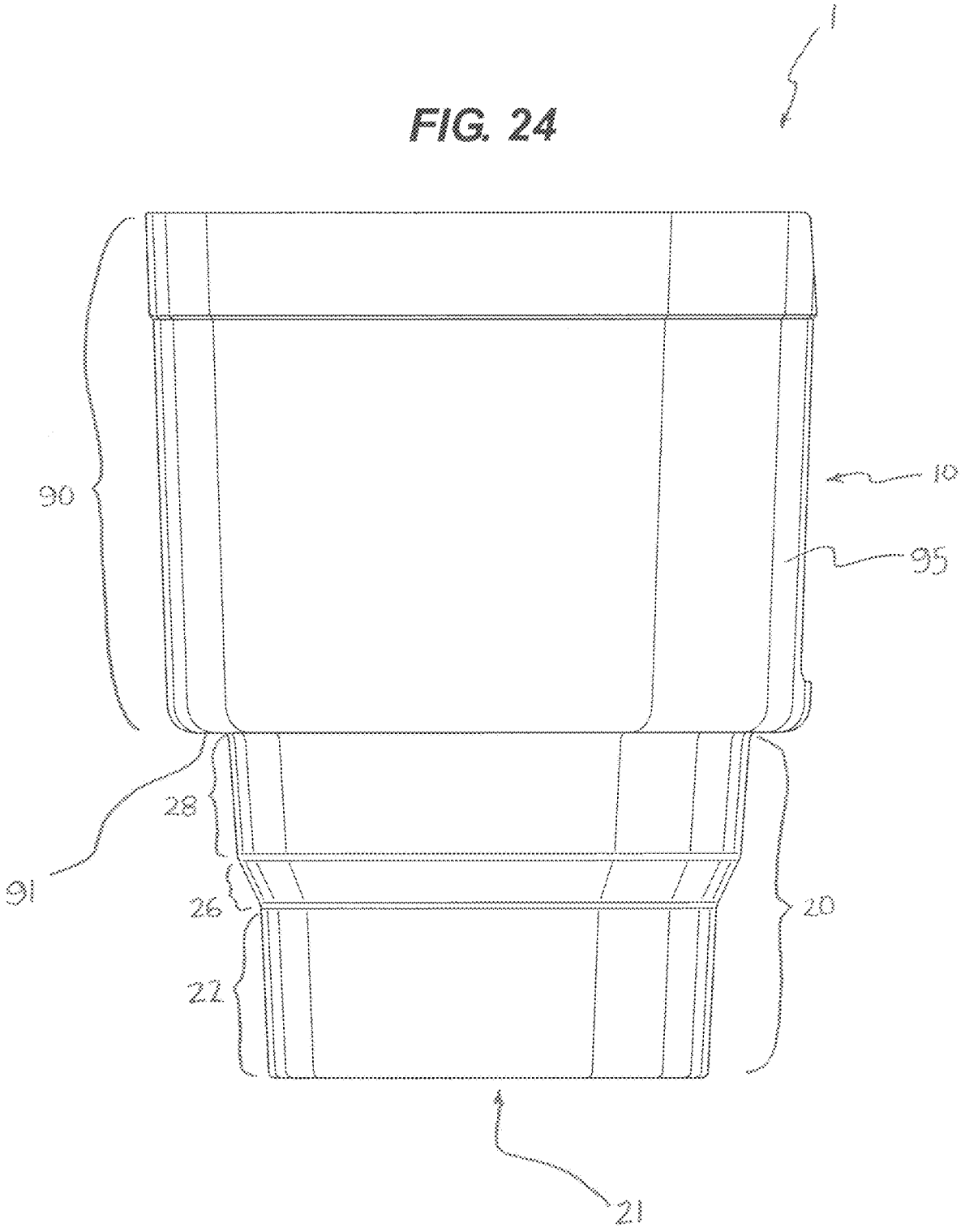
FIG. 24 is a right side view of the cup holder adaptor assembly of FIG. 22.
Figure 25:
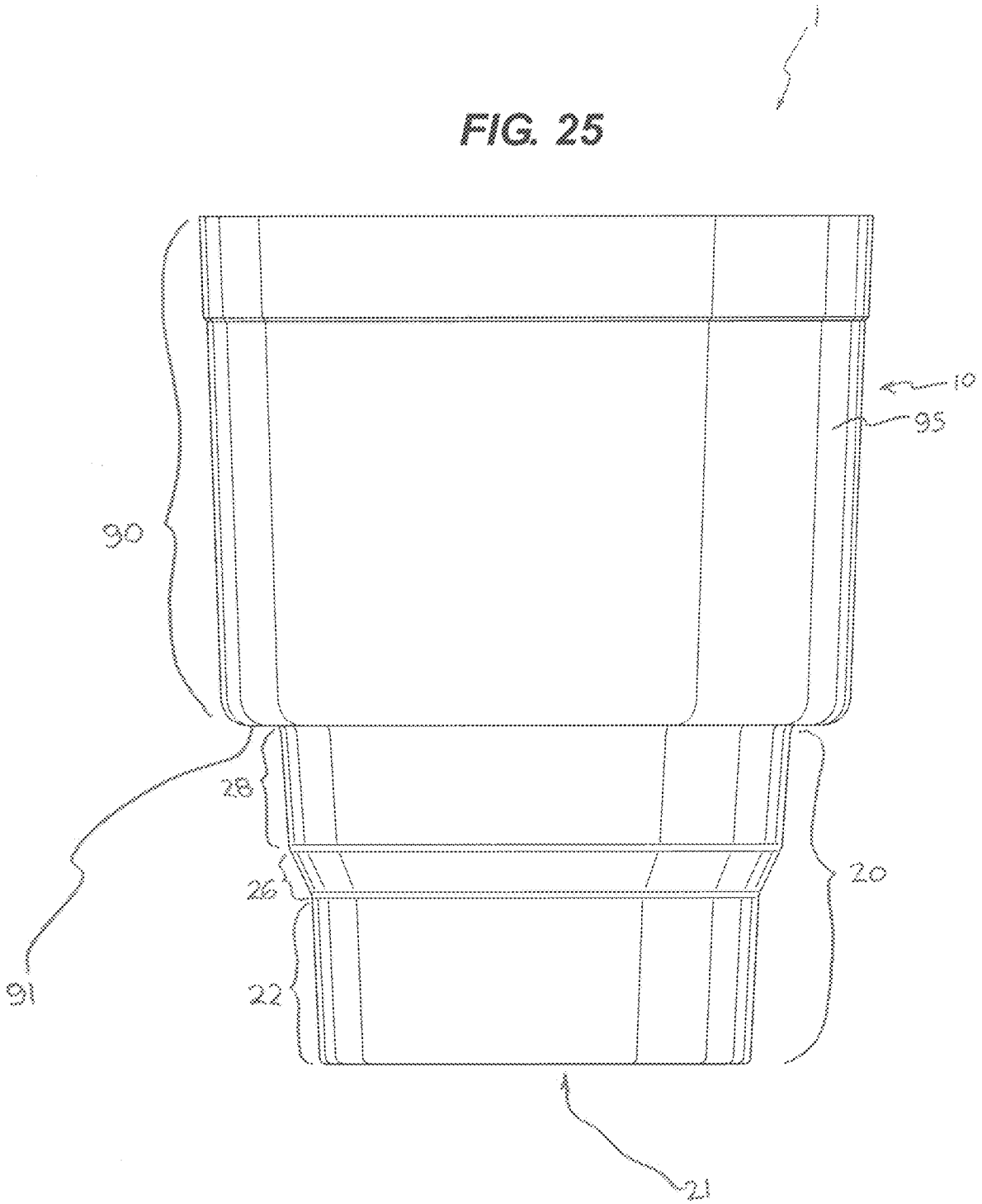
FIG. 25 is a rear view of the cup holder adaptor assembly of FIG. 22.
Figure 26:
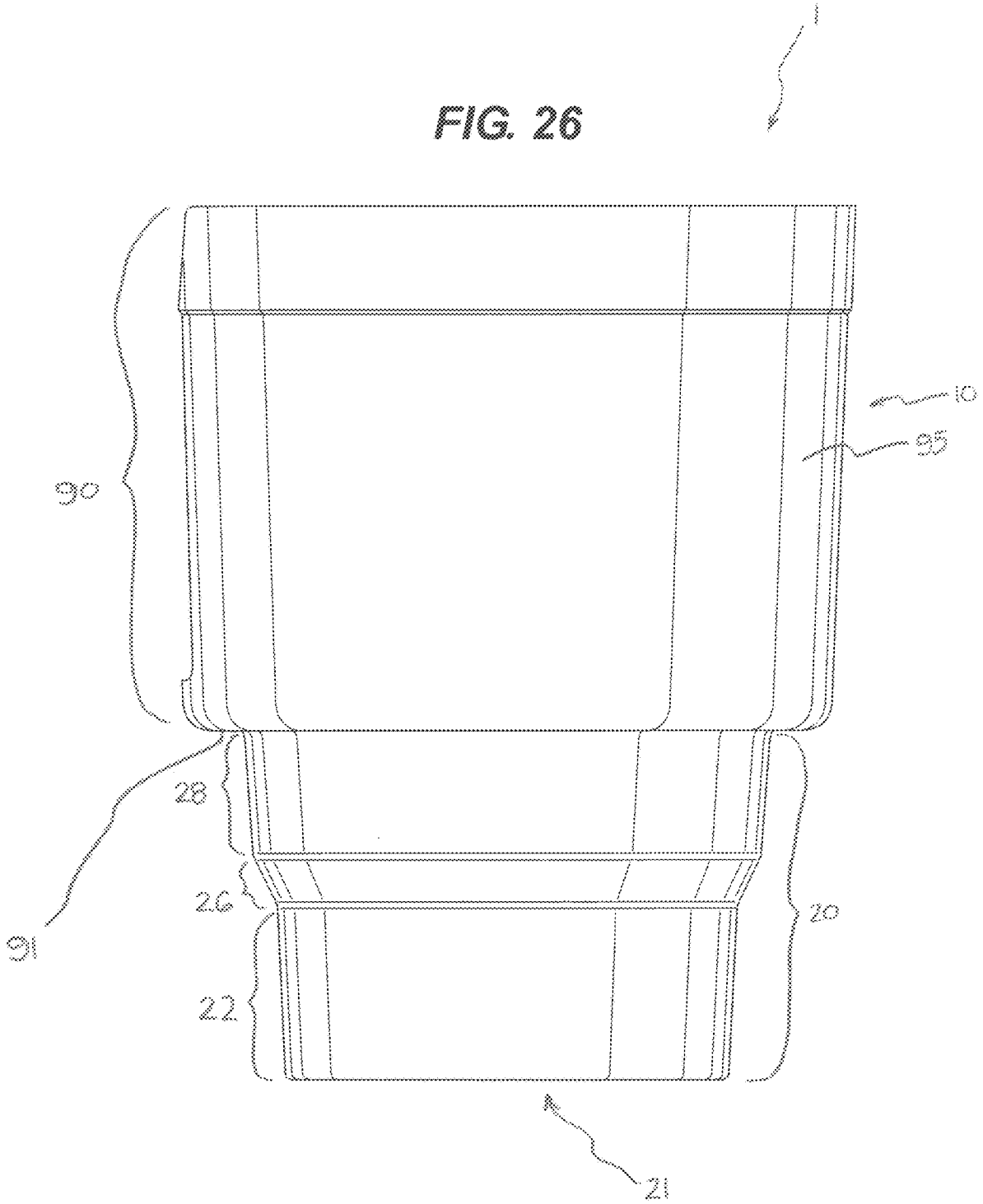
FIG. 26 is a left side view of the cup holder adaptor assembly of FIG. 22.
Figure 27:
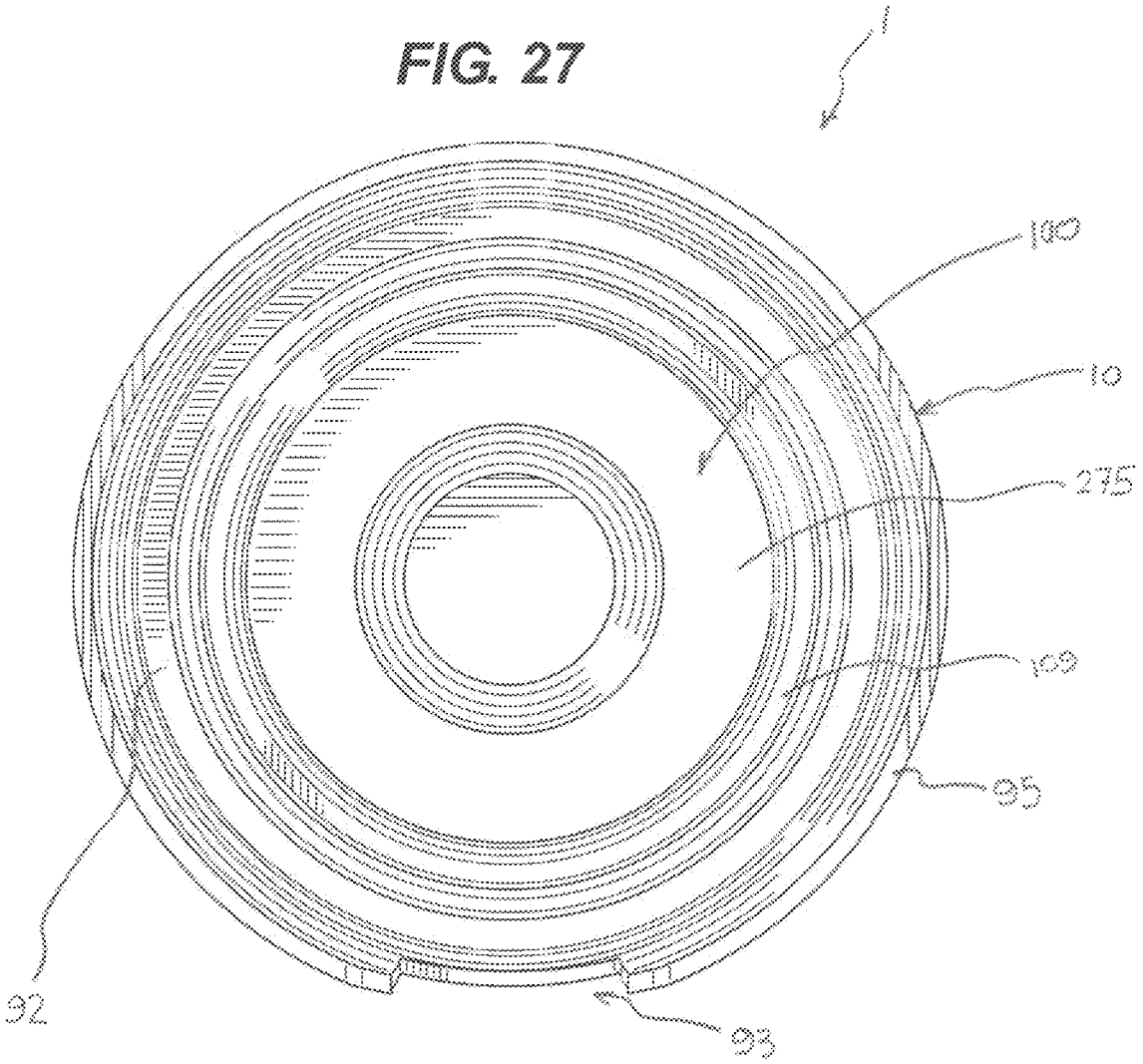
FIG. 27 is a top view of the cup holder adaptor assembly of FIG. 22.
Figure 28:
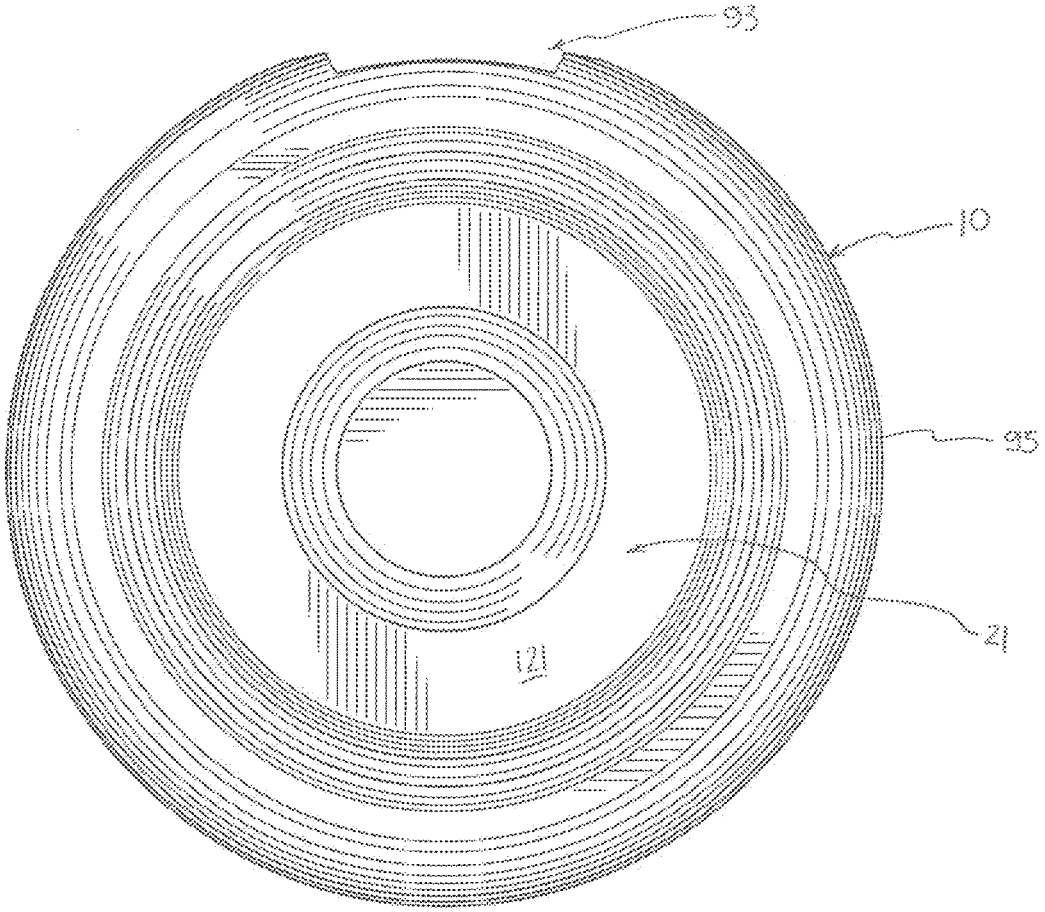
FIG. 28 is a bottom view of the cup holder adaptor assembly of FIG. 22.

With continued reference to the embodiment shown in FIGS. 1 and 8, the first side of the cup deck 100 has an annular deck surface 175, which preferably is at least substantially planar. In FIGS. 1 and 8, the deck surface 175 is located between an inner raised annular form 165 and an outer raised annular form 185. Preferably, the inner raised annular form 165 bounds a central opening 150 of the cup deck 100. Alternatively, the shape of the first side of the cup deck can be like that shown in FIG. 1 except the central opening is omitted.

When provided, the inner raised annular form 165 preferably comprises a raised wall section 168 that slopes upwardly from (and preferably is surrounded by) the annular deck surface 175 to a peak 169 of the raised wall section 168. The peak 169 of the raised wall section 168 is located radially inwardly of the annular deck surface 175.

When provided, the inner raised annular form 165 preferably is configured to seat, among other things, a bottle or can, such as a standard 12-ounce can, a 12-ounce slim can, or an 8.4 ounce slim can. In more detail, the inner raised annular form can have a dome-like configuration shaped and sized to be received within the concave pocket that is bounded by (e.g., defined at an underside thereof) the concave dome of the bottom of certain cans. It can thus be appreciated that the first side of the cup deck 100 preferably is configured to engage the bottom of a cup, can, or bottle so as to generally center it on a longitudinal axis LA of portable cup holder 10.

When provided, the inner raised annular form 165 can optionally have a diameter in a range of from 1 inch to 1.75 inches, such as about 1.5 inches. This can advantageously facilitate seating and centering plastic water bottles of common single-serving sizes, standard 12-ounce cans, and thin cans, to mention just a few examples.

Preferably, the annular deck surface 175 has width (measured in the radial direction) in a range of ¼ inch to 1 inch, such as about ½ inch. This can advantageously facilitate seating various cups, cans, and bottles of common sizes and shapes.

In FIGS. 1 and 8, the outer raised annular form 185 comprises (e.g., is) an upstanding annular rim. Here, the upstanding annular rim is located radially inwardly of the circumferential outer rim 109 of the cup deck 100. When provided, the upstanding annular rim can optionally have a diameter in a range of from 2¼ to 3 inches, or from 2½ to 2¾ inches, such as about 2.625 inches. As noted above, however, the dimensions mentioned herein are merely exemplary: they are not limiting.

Figure 33:
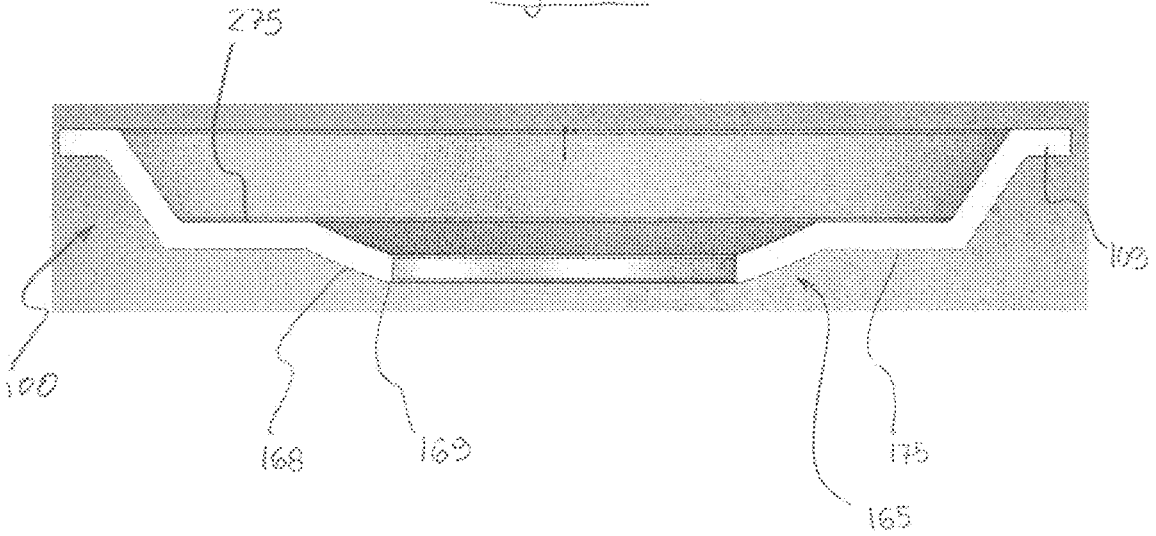
FIG. 33 is a cross-sectional view of another cup deck suitable for use in a cup holder adaptor assembly in accordance with certain embodiments of the present disclosure.
Figure 34:
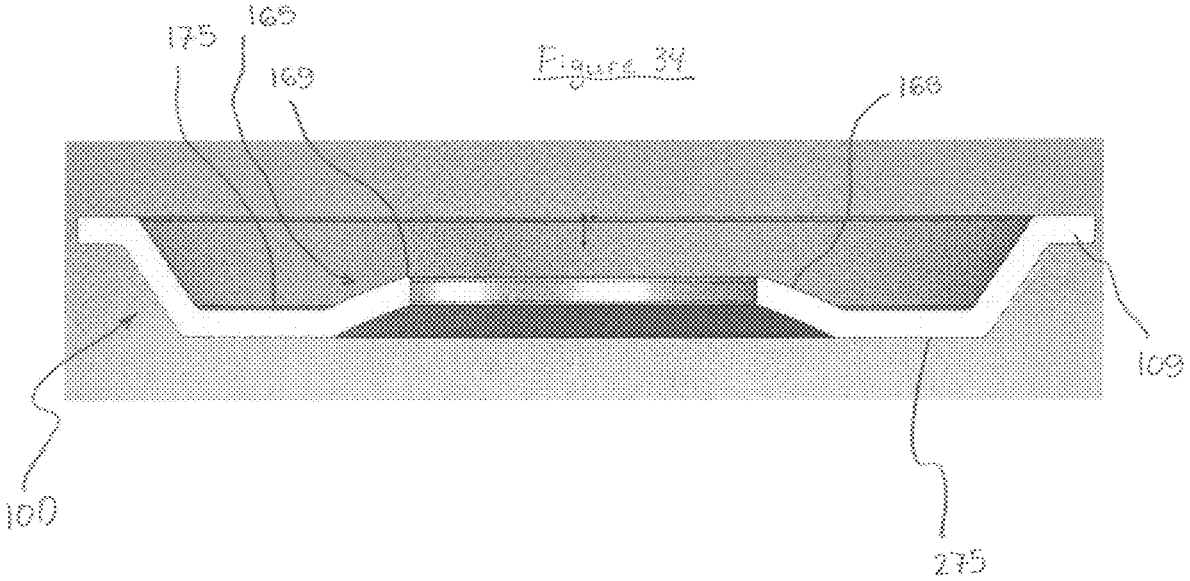
FIG. 34 is a cross-sectional view of still another cup deck suitable for use in a cup holder adaptor assembly in accordance with certain embodiments of the present disclosure.
Figure 35:
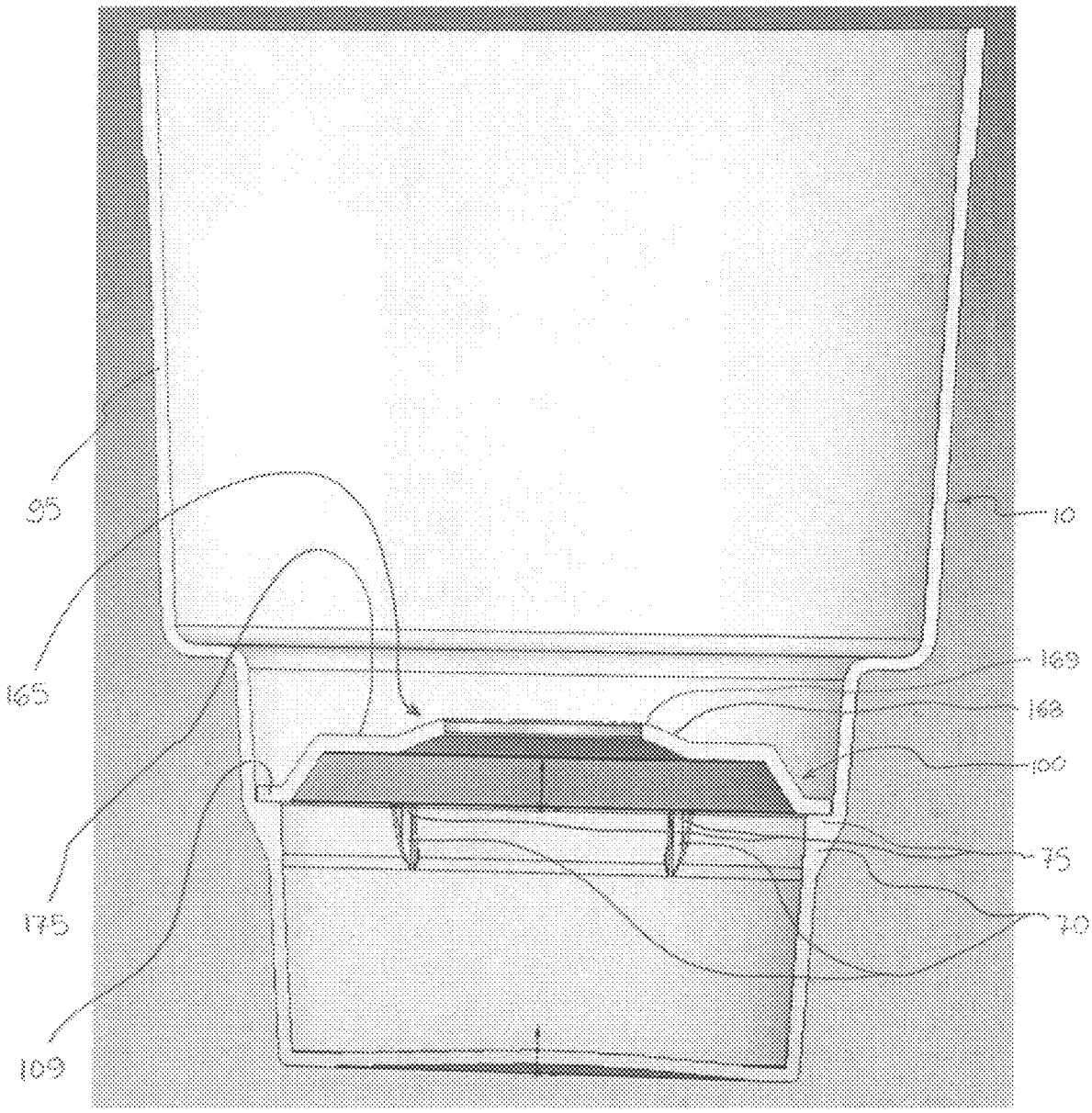
FIG. 35 is a cross-sectional view of a cup holder adaptor assembly in accordance with certain embodiments of the present disclosure, with the cup deck of FIG. 33 included.

The cup deck 100 can be provided in different forms. As noted above, FIGS. 1 and 8 depict one advantageous configuration for the cup deck. FIGS. 33 and 35 depict another suitable cup deck configuration. Here, the outer raised annular form is omitted. FIG. 34 depicts still another suitable cup deck configuration. In these designs, the optional inner raised annular form 165, as well as deck surfaces 175, 275, can be of the nature described above relative to the embodiment of FIGS. 1 and 8. Moreover, if desired, the central opening of the cup deck can be omitted in the designs of FIGS. 33 and 34.

The wall 95 that defines the upper section 90 of the portable cup holder 10 includes a sidewall portion, and the portable cup holder 10 preferably includes an annular circumferential floor section 92 that extends from the sidewall portion of the upper section 90 to the lower section 20 of the portable cup holder 10. This is perhaps best shown in FIGS. 1 and 8. Here, the annular circumferential floor section 92 defines an annular surface that preferably is planar (or at least substantially planar) and/or is parallel (or at least substantially parallel) to a base surface 121 of the bottom 21 of the portable cup holder. For relatively large cups, cans, bottles, and mugs, when seated within the portable cup holder 10, the bottom of the cup, can, bottle, or mug may rest on the annular circumferential floor section 92. This can be appreciated, for example, by referring to FIGS. 15, 22, and 36D.

When the cup deck 100 is mounted within the portable cup holder 10 (e.g., within the lower section 20 thereof) in the first configuration, the first side of the cup deck 100 faces away from the bottom 21 of the portable cup holder, and the second side of the cup deck 100 faces toward the bottom 21 of the portable cup holder. Reference is made to image (A) in FIG. 29, and the second image in FIG. 30. In this configuration, the second side of the cup deck 100 is adjacent (e.g., generally aligned with) the annular circumferential floor section 92.

When the cup deck 100 is mounted within the portable cup holder 10 (e.g., within the lower section 20 thereof) in the second configuration, the first side of the cup deck 100 faces toward the bottom 21 of the portable cup holder, and the second side of the cup deck 100 faces away from the bottom 21 of the portable cup holder. Reference is made to image (B) in FIG. 29, and the first image in FIG. 30. In this configuration, an annular deck surface 275 of the second side of the cup deck 100 preferably is spaced substantially below the annular circumferential floor section 92, e.g., by at least ¼ inch, such as by about ½ inch.

Preferably, the bottom 21 of the portable cup holder 10 has an interior surface comprising a floor surface area that is annular and substantially planar. In addition, the bottom 21 of the portable cup holder 10 preferably includes a raised central form surrounded by the floor surface area. When provided, the raised central form can comprise a raised wall section that slopes upwardly from the floor surface area to a substantially planar (or convex) top region. Thus, the optional raised central form can have a dome-like configuration configured to be received within the concave pocket that is bounded by (e.g., defined under) the concave dome of the bottom of certain cans. It can thus be appreciated that the interior of the bottom of the portable cup holder 10 preferably is configured to engage the bottom of a cup, can, or bottle so as to center it on a longitudinal axis LA of portable cup holder 10. In some cases, the interior of the bottom of the portable cup holder 10 is configured to seat, among other things, a thin bottle or a can, such as a 12-ounce slim can or an 8.4 ounce slim can.

When provided, the raised central form can optionally have a diameter in a range of from 1 inch to 1.75 inches, such as about 1.5 inches. This can advantageously facilitate seating and centering certain plastic water bottles of single-serving size and thin cans, to mention just two examples.

The raised central form on the interior of the bottom of the illustrated portable cup holder can optionally have substantially the same configuration as the optional inner raised annular form 165. For example, its configuration can optionally be identical, or it can be the same (or substantially the same) except for not having a central opening. In such cases, it is possible to seat and center certain cups, cans, or bottles similarly whether or not the cup deck is used, e.g., since both the cup deck and the inside of the bottom of the portable cup holder have identical (or at least substantially similar) raised seating structures surrounded by annular seating surfaces. It is to be appreciated, however, that certain sizes of cups, cans, and bottles will not fit entirely within the bottom section of the portable cup holder 10, and thus may need to be seated on the cup deck 100, on the annular circumferential floor section 92, or both. This can be appreciated by referring to FIG. 36.

Figure 36:
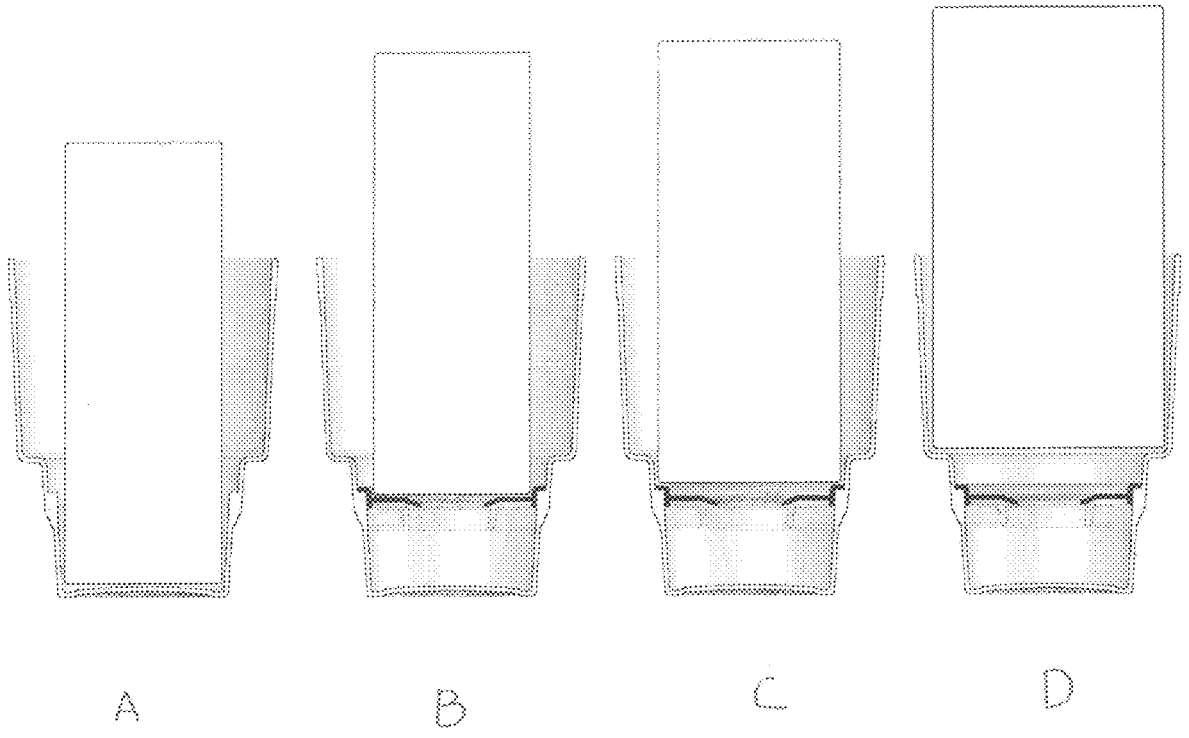
FIG. 36 is a set of four images of a cup holder adaptor assembly in accordance with certain embodiments of the present disclosure, with four different seats of the assembly shown.

With continued reference to FIG. 36, it can be appreciated that the present cup holder adaptor assembly 1 preferably has a plurality of (e.g., three or more) different seats. Four different seats are shown in FIG. 36. As can be appreciated, a plurality (optionally all) of the seats may be at different elevations of the portable cup holder (e.g., they may be located different distances from a top lip and/or from a bottom of the portable cup holder 10). Moreover, at least three of the seats preferably are of different diameter from one another. Thus, the cup holder adaptor assembly 1 preferably is configured to stably receive cups, cans, or bottles of at least three (optionally four or more) different diameters. Furthermore, if the illustrated cup deck is reversed, it provides a fifth seat. Thus, the present cup holder adaptor assembly 1 can optionally have four or more (e.g., at least five) different seats. It follows that the cup holder adaptor assembly 1 preferably is configured to stably receive cups, cans, or bottles in at least four (e.g., at least five) different seated positions within the portable cup holder 10. While this can optionally be the case for any embodiment of the present disclosure, it is by no means required. For example, various embodiments can be provided wherein the assembly includes a cup deck and yet there are fewer seats.

Figure 31:
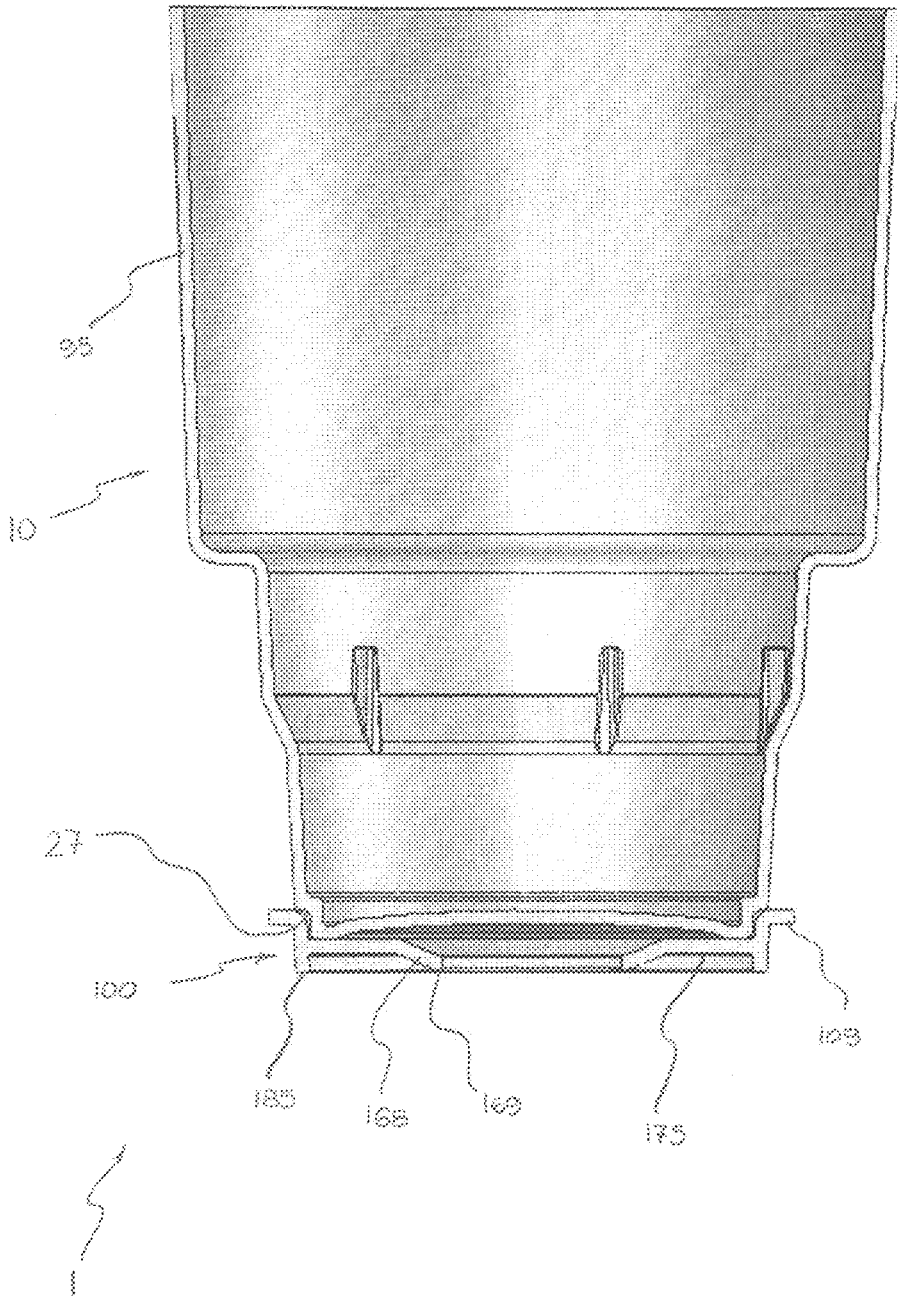
FIG. 31 is a cross-sectional view of a cup holder adaptor assembly in accordance with certain embodiments of the present disclosure, wherein a cup deck thereof is configured to nest on an exterior bottom of a portable cup holder of the assembly, with the cup deck shown nested with the portable cup holder in a first orientation.
Figure 32:
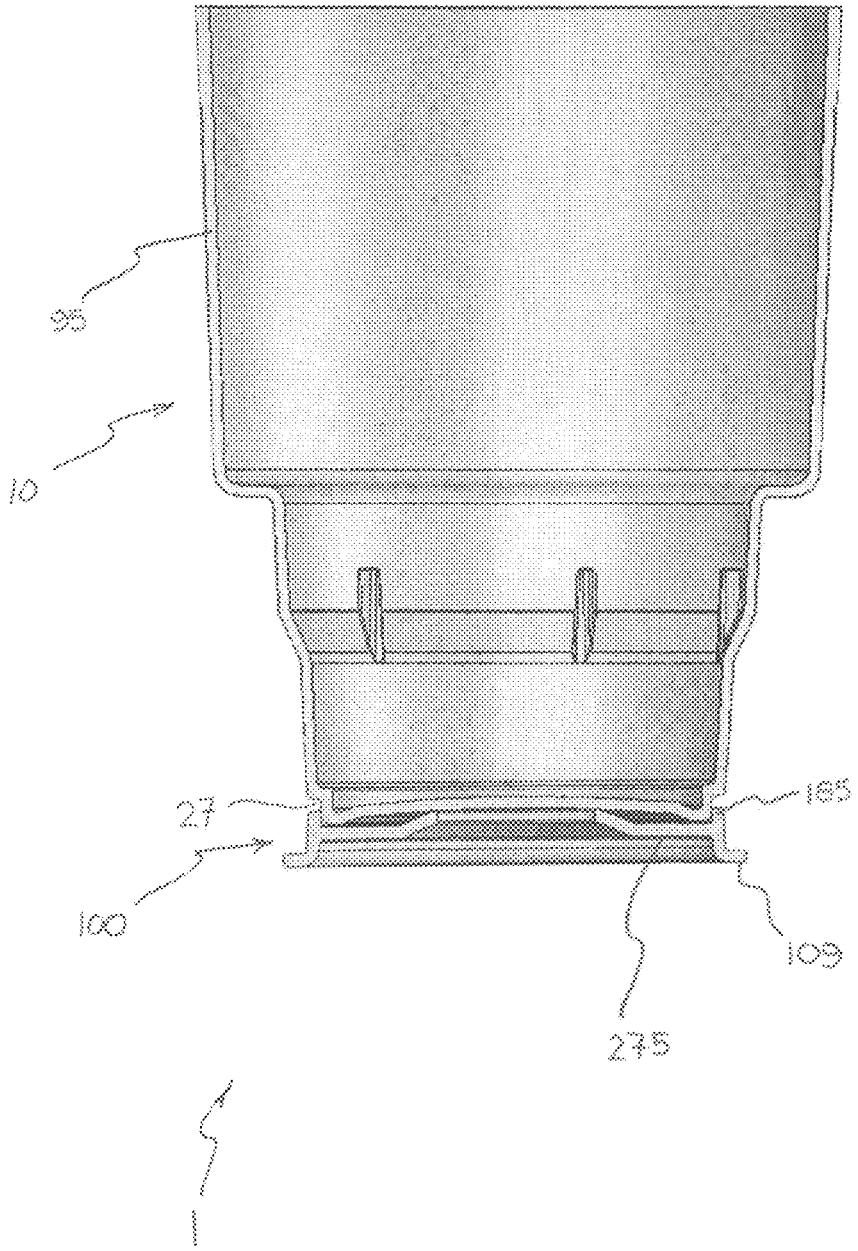
FIG. 32 is a cross-sectional view of the cup holder adaptor assembly of FIG. 31, with the cup deck shown nested with the portable cup holder in a second orientation.

In some embodiments, the bottom 21 of the portable cup holder 10 has an exterior that is configured to nest with the cup deck 100. Reference is made to FIGS. 31 and 32. Here, it can be appreciated that the illustrated cup deck 100 is configure to nest, in either of two orientations, with the bottom 21 of the portable cup holder 10. In other cases, the cup deck is only configured to nest with the bottom of the portable cup holder when the cup deck is on one orientation. In still other cases, the cup deck is not configured to nest with the bottom of the portable cup holder.

In the embodiment of FIGS. 31 and 32, an inside-corner groove 27 extends circumferentially about an exterior of the bottom 21 of the portable cup holder 10. When provided, this inside-corner groove 27 is configured to receive the cup deck 100 (e.g., a rim portion 109 or 185 thereof) when the bottom 21 of the portable cup holder 10 is nested with the cup deck 100.

Thus, various embodiments of the cup holder adaptor assembly are disclosed. One skilled in the art will appreciate that the present invention can be practiced with embodiments other than those disclosed. The disclosed embodiments are presented for purposes of illustration and not limitation, and the present invention is limited only by the claims that follow.

What is claimed is:

1. A cup holder adaptor assembly comprising a portable cup holder and a cup deck, the cup deck configured to be mounted removably within a lower section of the portable cup holder, such that when the cup deck is mounted removably within the lower section of the portable cup holder a storage compartment is created between the cup deck and a bottom of the portable cup holder, wherein the cup holder adaptor assembly is configured such that the cup deck can be selectively mounted within the lower section of the portable cup holder in either of two configurations, the two configurations being a first configuration and a second configuration, wherein the cup deck has opposed first and second sides, the first side having a different configuration than the second side, and wherein the first side of the cup deck has an annular deck surface that is at least substantially planar and is located between an inner raised annular form and an outer raised annular form.

2. The cup holder adaptor assembly of claim 1 wherein the portable cup holder comprises both the lower section and an upper section, the lower section having a smaller diameter than the upper section.

3. The cup holder adaptor assembly of claim 2 wherein the lower section of the portable cup holder includes both a bottom portion and an intermediate portion, the intermediate portion of the lower section being located between the bottom portion of the lower section and the upper section of the portable cup holder, the bottom portion of the lower section having a smaller diameter than the intermediate portion of the lower section.

4. The cup holder adaptor assembly of claim 2 wherein the upper section of the portable cup holder includes a sidewall, and the portable cup holder includes an annular circumferential floor section that extends from the sidewall of the upper section to the lower section of the portable cup holder.

5. The cup holder adaptor assembly of claim 4 wherein when the cup deck is mounted within the lower section of the portable cup holder in the first configuration, the first side of the cup deck faces away from the bottom of the portable cup holder, the second side of the cup deck faces toward the bottom of the portable cup holder, and the first side of the cup deck is adjacent the annular circumferential floor section.

6. The cup holder adaptor assembly of claim 5 wherein when the cup deck is mounted within the lower section of the portable cup holder in the second configuration, the second side of the cup deck faces away from the bottom of the portable cup holder, the first side of the cup deck faces toward the bottom of the portable cup holder, and an annular deck surface of the second side of the cup deck is spaced below the annular circumferential floor section by at least ¼ inch.

7. The cup holder adaptor assembly of claim 1 wherein the bottom of the portable cup holder has an interior surface comprising a floor surface area that is annular and substantially planar, the bottom of the portable cup holder further comprising a raised central form surrounded by the floor surface area, and wherein the raised central form on the bottom of the portable cup holder has substantially the same configuration as the inner raised annular form on the first side of the cup deck.

8. A cup holder adaptor assembly comprising a portable cup holder and a cup deck, the cup deck configured to be mounted removably within a lower section of the portable cup holder, such that when the cup deck is mounted removably within the lower section of the portable cup holder a storage compartment is created between the cup deck and a bottom of the portable cup holder, wherein the portable cup holder comprises both the lower section and an upper section, the lower section having a smaller diameter than the upper section, the lower section including both a bottom portion and an intermediate portion, the intermediate portion of the lower section being located between the bottom portion of the lower section and the upper section of the portable cup holder, the bottom portion of the lower section having a smaller diameter than the intermediate portion of the lower section, and wherein the portable cup holder includes a tapered portion extending between the intermediate and bottom portions of the lower section, wherein the portable cup holder comprises a wall bounding an interior space of the portable cup holder, the wall having one or more shoulders that receive the cup deck when the cup deck is mounted within the lower section of the portable cup holder, and the one or more shoulders are defined by a plurality of ribs spaced circumferentially apart from one another about an interior of the wall and projecting from an interior side of the tapered portion.

9. The cup holder adaptor assembly of claim 8 wherein each rib projects from an interior side of both the tapered portion and the intermediate portion.

10. The cup holder adaptor assembly of claim 8 wherein the portable cup holder is configured to provide at least five different seats for stably receiving cups, cans, or bottles.

11. The cup holder adaptor assembly of claim 10 wherein the five seats are each located a different distance from the bottom of the portable cup holder.

12. The cup holder adaptor assembly of claim 11 wherein at least three seats are of a different diameter from one another.

13. The cup holder adaptor assembly of claim 1 wherein the inner raised annular form on the first side of the cup deck has a dome configuration shaped and sized to be received within a concave pocket defined by an underside of a concave dome on a bottom of a can.

14. The cup holder adaptor assembly of claim 1 wherein the portable cup holder is configured to provide at least five different seats for stably receiving cups, cans, or bottles.

15. The cup holder adaptor assembly of claim 14 wherein the five seats are each located a different distance from the bottom of the portable cup holder.

16. The cup holder adaptor assembly of claim 15 wherein at least three seats are of a different diameter from one another.

17. A cup holder adaptor assembly comprising a portable cup holder and a cup deck, the cup deck configured to be mounted removably within a lower section of the portable cup holder, such that when the cup deck is mounted removably within the lower section of the portable cup holder a storage compartment is created between the cup deck and a bottom of the portable cup holder, the portable cup holder including an upper section that extends upwardly and outwardly from the lower section, such that the lower section has an inner diameter of greater than two inches and less than 3 inches, and the upper section has an inner diameter of greater than 3.5 inches and less than 4.5 inches, the upper section comprising a wall having a slot formed therein such that the slot is configured to receive a handle of a mug when the mug is rested stably in the portable cup holder, wherein the cup holder adaptor assembly is configured such that the cup deck can be selectively mounted within the lower section of the portable cup holder in either of two configurations, the two configurations being a first configuration and a second configuration, and wherein the cup deck has opposed first and second sides, the first side having a different configuration than the second side, and the first side of the cup deck configured to engage a bottom of a cup, can, or bottle so as to generally center the cup, can, or bottle on a longitudinal axis of the portable cup holder.

18. The cup holder adaptor assembly of claim 17 wherein a single integral piece defines an entirety of the portable cup holder.

19. The cup holder adaptor assembly of claim 17 wherein the lower section includes both a bottom portion and an intermediate portion, the intermediate portion of the lower section being located between the bottom portion of the lower section and the upper section of the portable cup holder, the bottom portion of the lower section having a smaller diameter than the intermediate portion of the lower section, and wherein the portable cup holder includes a tapered section extending between the intermediate and bottom portions of the lower section.

20. The cup holder adaptor assembly of claim 17 wherein the portable cup holder is configured to provide at least five different seats for stably receiving cups, cans, or bottles, wherein the five seats are each located a different distance from the bottom of the portable cup holder, and wherein at least three seats are of a different diameter from one another.

21. The cup holder adaptor assembly of claim 17 wherein the storage compartment has a height of from 1 inch to 2.25 inches.

22. The cup holder adaptor assembly of claim 17 wherein a bottommost portion of the cup deck when mounted within the lower section in either of the two configurations is spaced apart upwardly from the bottom of the portable cup holder.

* * * * *